US009058719B2

(12) United States Patent
Miner et al.

(10) Patent No.: US 9,058,719 B2
(45) Date of Patent: Jun. 16, 2015

(54) GAMING TERMINAL CHAIR ELECTRICAL INTERFACE

(75) Inventors: Eric T. Miner, Chicago, IL (US); Scot Salzman, Buffalo Grove, IL (US); Toriono A. Granger, Chicago, IL (US)

(73) Assignee: WMS GAMING INC., Waukegan, IL (US)

( * ) Notice: Subject to any disclaimer, the term of this patent is extended or adjusted under 35 U.S.C. 154(b) by 1005 days.

(21) Appl. No.: 13/102,994

(22) Filed: May 6, 2011

(65) Prior Publication Data

US 2012/0282997 A1 Nov. 8, 2012

(51) Int. Cl.
*G07F 17/32* (2006.01)

(52) U.S. Cl.
CPC ..... *G07F 17/3216* (2013.01); *G07F 17/3204* (2013.01)

(58) Field of Classification Search
None
See application file for complete search history.

(56) References Cited

U.S. PATENT DOCUMENTS

| | | | | |
|---|---|---|---|---|
| 4,510,553 | A * | 4/1985 | Faultersack | 361/788 |
| 5,394,552 | A * | 2/1995 | Shirota | 713/323 |
| 5,547,385 | A * | 8/1996 | Spangler | 439/101 |
| 6,119,237 | A * | 9/2000 | Cho | 713/300 |
| 6,160,321 | A * | 12/2000 | Shin et al. | 307/66 |
| 6,354,885 | B1 * | 3/2002 | Bradley et al. | 439/681 |
| 7,118,483 | B2 * | 10/2006 | Beadell et al. | 463/46 |
| 7,170,468 | B2 * | 1/2007 | Knopf | 345/1.3 |
| 7,367,886 | B2 | 5/2008 | Loose et al. | |
| 7,479,063 | B2 | 1/2009 | Pryzby et al. | |
| 7,543,779 | B1 * | 6/2009 | Lewis et al. | 244/172.4 |
| 7,637,816 | B2 * | 12/2009 | Canterbury et al. | 463/47 |
| 7,658,445 | B2 | 2/2010 | Mittler et al. | |
| 7,766,747 | B2 | 8/2010 | Bonney et al. | |
| 2007/0270216 | A1 | 11/2007 | Pryzby | |
| 2008/0039215 | A1 * | 2/2008 | Hahn | 463/47 |
| 2008/0054561 | A1 * | 3/2008 | Canterbury et al. | 273/148 B |
| 2008/0211276 | A1 | 9/2008 | Rasmussen | |
| 2008/0246321 | A1 * | 10/2008 | Canterbury | 297/217.4 |
| 2009/0318237 | A1 * | 12/2009 | Bleich et al. | 463/46 |
| 2011/0003631 | A1 | 1/2011 | Tastad | |

FOREIGN PATENT DOCUMENTS

WO WO 2006/015335 2/2006

* cited by examiner

*Primary Examiner* — Rexford Barnie
*Assistant Examiner* — David Shiao
(74) *Attorney, Agent, or Firm* — Nixon Peabody LLP

(57) ABSTRACT

Gaming terminals, gaming systems, and electrical and mechanical connector assemblies for coupling a gaming terminal to a chair positioned in front of the gaming terminal are presented herein. A gaming system is disclosed. The gaming system includes a gaming terminal for playing a wagering game and a chair positioned in front of the gaming terminal. The chair includes electronic components operated by a digital data signal and powered by a power supply signal. The gaming terminal includes an electrical connector assembly for coupling to a complementary electrical connector assembly on the chair. The electrical connector assembly also includes a switching device for automatically electrically coupling the electronic components with a power supply signal from a power supply once the respective electrical connector assemblies are securely coupled.

32 Claims, 12 Drawing Sheets

GAMING TERMINAL CHAIR ELECTRICAL INTERFACE

COPYRIGHT

A portion of the disclosure of this patent document contains materials subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present disclosure relates generally to wagering game terminals and gaming systems, and more particularly to an electrical interface between a gaming terminal and an associated chair removably attachable to the gaming terminal.

BACKGROUND

Gaming terminals, such as slot machines, video poker machines, and the like, have been a cornerstone of the gaming industry for several years. Generally, the popularity of such machines with players is dependent on the likelihood (or perceived likelihood) of winning money at the machine, as well as the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators therefore strive to employ the most entertaining and exciting machines, features, and enhancements available because such machines, features, and enhancements attract frequent play and, hence, increase profitability to the operator.

Many gaming terminals include a chair positioned in front of the gaming terminal to allow a player of the wagering game to sit on the chair while playing the wagering game. Some chairs may further incorporate electronic components, such as speakers for providing a surround sound experience to the player or input devices to allow a player to provide inputs to the gaming terminal for playing the wagering game. Some chairs can also include electronic components for positioning, moving, and/or vibrating aspects of the chair to adjust a position of the chair and/or to provide a tactile sensation to a player sitting in the chair. Chairs including electronic components generally must receive electrical signals for operating the electronic components. In chairs having electronic components requiring a power supply from a primary voltage power supply, such as an AC power supply, the electrical signals conveyed to the chair generally include both digital data signals and power signals.

Chairs associated with gaming terminals can receive the electrical signals via an electrical interface with the gaming terminal. In particular, the gaming terminal and the chair can each be fitted with corresponding electrical connectors near the bases of each such that the chair can be electrically coupled to the gaming terminal at a base of the gaming terminal and a base of the chair.

In the gaming industry, areas around a gaming terminal are commonly serviced, cleaned, and otherwise maintained. During servicing of the gaming terminal and its surrounding areas, a chair coupled to the gaming terminal is generally removed and repositioned to allow for servicing. Conventionally, during such servicing, any electrical connectors of the gaming terminal providing high or supply voltage power supply signals (e.g., 120V or 240V) to the chair continue to be energized with the high (supply) voltage power supply signals and undesirably provide a risk of arcing from the energized connector. In particular, the energized connector risks arcing to its corresponding mating connector on the chair during a coupling and decoupling operation when the corresponding mating connector is brought near to the energized connector. Over time, such repeated arcing events degrade the connectors and raise the resistance of the connectors, which causes additional electrical consumption and potentially decreases the reliability of the connection. Furthermore, such repeated arcing in an area near the floor, cabinet of the gaming terminal, and base of the chair provide a risk of fire and/or electrical shock to servicing personnel.

SUMMARY

Aspects of the present disclosure provide a gaming system for providing a wagering game. The gaming system includes a gaming terminal has an input device for receiving an indication of a wager to play the wagering game. The gaming terminal further has an electrical connector assembly. The gaming system also includes a chair configured to receive, via a complementary electrical connector assembly corresponding to the electrical connector assembly of the gaming terminal, an alternating current power supply signal from an alternating current power supply. The gaming system also includes a switching device adapted to automatically electrically couple the alternating current power supply to electronics in the chair responsive to the electrical connector assembly of the gaming terminal being removably coupled to the complementary electrical connector assembly of the chair.

Aspects of the present disclosure further provide a system for electrically coupling a gaming terminal to an associated chair positioned in front of the gaming terminal. The gaming terminal is adapted for receiving an indication of a wager from a player for playing a wagering game via the gaming terminal. The system includes an electrical connector assembly mounted to the gaming terminal. The electrical connector assembly includes a first electrical connector accessible from an exterior of the gaming terminal. The system also includes a switching device for automatically coupling a power supply to the first electrical connector responsive to the electrical connector assembly being removably coupled to a complementary electrical connector assembly of the chair.

Aspects of the present disclosure further provide a system for electrically coupling a chair to a gaming terminal. The gaming terminal is adapted for receiving an indication of a wager from a player for playing a wagering game via the gaming terminal. The system includes an electrical connector assembly for conveying power supply signals from a power supply associated with the gaming terminal to an electronic component associated with the chair. The electrical connector assembly includes a first electrical connector electrically connected to the electronic component, and the electrical connector assembly is movable with the chair. The system also includes a switch activator for automatically activating a switching device adapted for coupling a power supply to a connector corresponding to the first electrical connector responsive to the electrical connector assembly being removably coupled to a complementary electrical connector mounted to the gaming terminal.

Aspects of the present disclosure further provide a system for safely electrically coupling a gaming terminal to a chair positioned in front of the gaming terminal. The gaming terminal is adapted for receiving an indication of a wager from a player related to a wagering game. The system includes an electrical connector assembly mounted to a base of the gaming terminal. The electrical connector assembly includes a plurality of terminals. The system also includes a complementary electrical connector assembly movable with the chair. The complementary electrical connector assembly includes a plurality of terminals adapted to mate with the plurality of terminals of the electrical connector assembly. The complementary electrical connector assembly is electrically coupled with an electronic component adapted to receive power from an alternating current power supply. The system also includes means for selectively electrically coupling an alternating current power supply to the plurality of terminals of the electrical connector assembly responsive to the plurality of terminals of the electrical connector assembly and the complementary electrical connector assembly being securely coupled.

Aspects of the present disclosure also provide a method for electrically coupling a gaming terminal to a chair. The gaming terminal is adapted for receiving an indication of a wager from a player for playing a wagering game via the gaming terminal. The method includes urging the chair toward the gaming terminal. The gaming terminal has an electrical connector assembly with a plurality of electrical terminals corresponding to a plurality of electrical terminals of a complementary electrical connector assembly. The complementary electrical connector assembly is mounted to the chair, and the chair is positioned such that the electrical connector assembly is aligned to receive the complementary electrical connector assembly. The method also includes removably attaching the chair to the gaming terminal via a latching device. The method also includes securely coupling the respective plurality of electrical terminals of the electrical connector assembly and the complementary electrical connector assembly. The method also includes automatically activating a switching device responsive to the respective plurality of electrical terminals of the electrical connector assembly and the complementary electrical connector assembly being securely coupled. The switching device is adapted for connecting an alternating current power supply to the electrical connector assembly of the gaming terminal such that power from the alternating current power supply is delivered to an electronic component associated with the chair via the complementary electrical connector assembly.

The above summary is not intended to represent each embodiment or every aspect of the present disclosure. Rather, the summary merely provides an exemplification of some of the novel features presented herein. The above features and advantages, and other features and advantages of the present disclosure, will be readily apparent from the following detailed description of exemplary embodiments and best modes for carrying out the present invention when taken in connection with the accompanying drawings and the appended claims.

Figure 1:
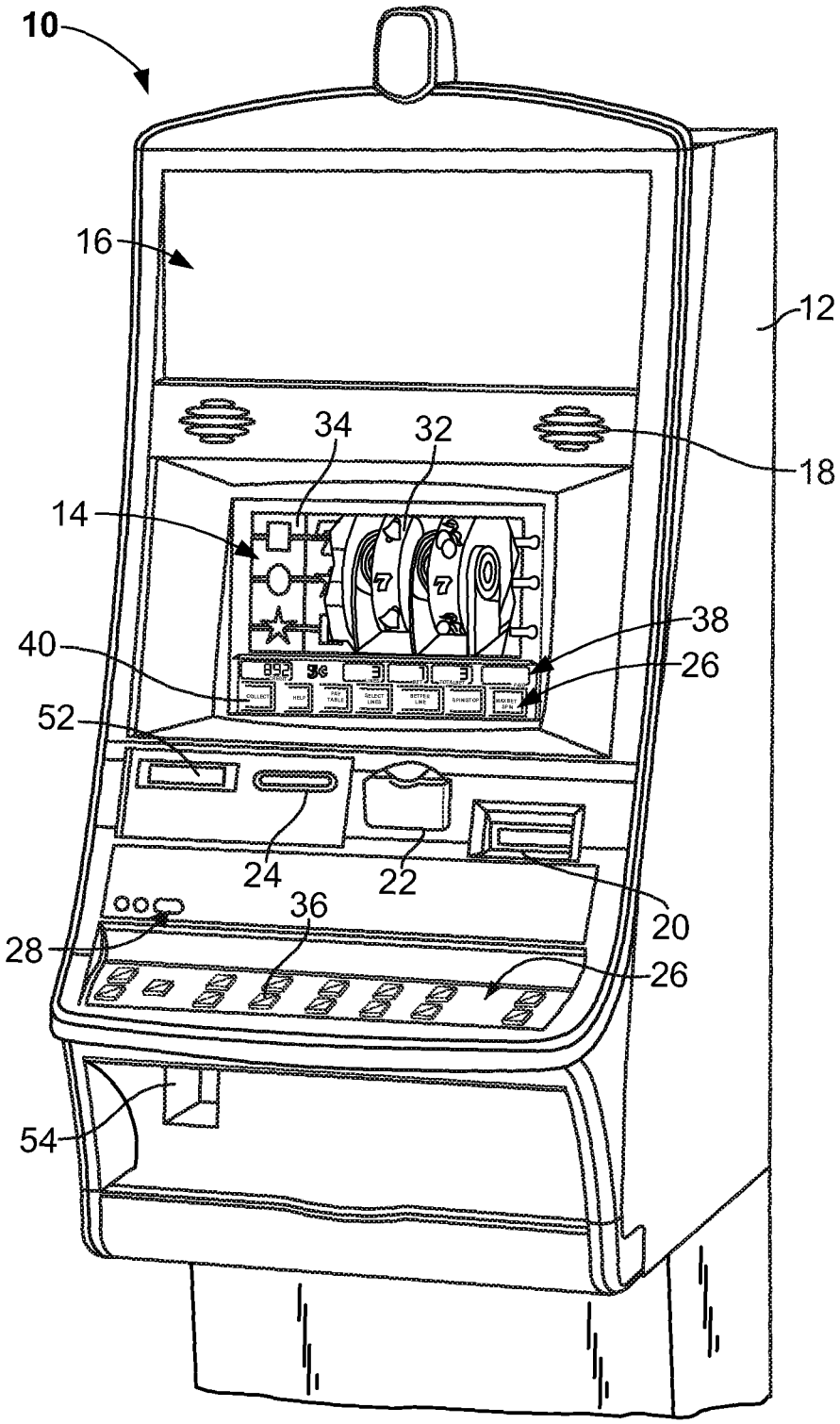
FIG.1 (Prior Art)
FIG. 1 is a perspective-view illustration of an exemplary free-standing gaming terminal according to aspects of the present disclosure.

While the aspects of this disclosure are susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there are shown in the drawings and will herein be described in detail representative embodiments with the understanding that the present disclosure is to be considered as an exemplification of the various aspects and principles of the invention, and is not intended to limit the broad aspect of the invention to the embodiments illustrated. To that extent, elements and limitations that are disclosed, for example, in the Abstract, Summary, and Detailed Description of the Embodiments sections, but not explicitly set forth in the claims, should not be incorporated into the claims, singly or collectively, by implication, inference or otherwise.

Referring to FIG. 1, there is shown a gaming terminal 10 similar to those used in gaming establishments, such as casinos. With regard to the present disclosure, the gaming terminal 10 may be any type of gaming terminal and may have varying structures and methods of operation. For example, in some aspects, the gaming terminal 10 can be an electromechanical gaming terminal configured to play mechanical slots, whereas in other aspects, the gaming terminal is an electronic gaming terminal configured to play a video casino game, such as slots, keno, poker, blackjack, roulette, craps, etc. It should be understood that although the gaming terminal 10 is shown as a free-standing terminal of the upright type, the gaming terminal is readily amenable to implementation in a wide variety of other forms such as a free-standing terminal of the slant-top type, a portable or handheld device primarily used for gaming, such as is disclosed by way of example in PCT Patent Application No. PCT/US2007/000792 filed Jan. 11, 2007, titled "Handheld Device for Wagering Games," which is incorporated herein by reference in its entirety, a mobile telecommunications device such as a mobile telephone or personal digital assistant (PDA), a counter-top or bar-top gaming terminal, or other personal electronic device, such as a portable television, MP3 player, entertainment device, etcetera.

The gaming terminal 10 illustrated in FIG. 1 comprises a cabinet or housing 12. For output devices, this embodiment of the gaming terminal 10 includes a primary display area 14, a secondary display area 16, and one or more audio speakers 18. The primary display area 14 and/or secondary display area 16 variously displays information associated with wagering games, non-wagering games, community games, progressives, advertisements, services, premium entertainment, text messaging, emails, alerts or announcements, broadcast information, subscription information, etc. appropriate to the particular mode(s) of operation of the gaming terminal. For input devices, the gaming terminal 10 illustrated in FIG. 1 includes a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements exist and are readily utilizable in any number of combinations to create various forms of a gaming terminal in accord with the present concepts.

The primary display area 14 include, in various aspects of the present concepts, a mechanical-reel display, a video display, or a combination thereof in which a transmissive video display is disposed in front of the mechanical-reel display to portray a video image in superposition over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display is, in various embodiments, a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10, or other form factor, such as is shown by way of example in FIG. 1. The primary display area 14 includes, in relation to many aspects of wagering games conducted on the gaming terminal 10, one or more paylines 30 (see FIG. 3) extending along a portion of the primary display area. In the illustrated embodiment of FIG. 1, the primary display area 14 comprises a plurality of mechanical reels 32 and a video display 34, such as a transmissive display (or a reflected image arrangement in other embodiments), in front of the mechanical reels 32. If the wagering game conducted via the gaming terminal 10 relies upon the video display 34 only and not the mechanical reels 32, the mechanical reels 32 are optionally removed from the interior of the terminal and the video display 34 is advantageously of a non-transmissive type. Similarly, if the wagering game conducted via the gaming terminal 10 relies only upon the mechanical reels 32, but not the video display 34, the video display 34 depicted in FIG. 1 is replaced with a conventional glass panel. Further, in still other embodiments, the video display 34 is disposed to overlay another video display, rather than a mechanical-reel display, such that the primary display area 14 includes layered or superimposed video displays. In yet other embodiments, the mechanical-reel display of the above-noted embodiments is replaced with another mechanical or physical member or members such as, but not limited to, a mechanical wheel (e.g., a roulette game), dice, a pachinko board, or a diorama presenting a three-dimensional model of a game environment.

Video images in the primary display area 14 and/or the secondary display area 16 are rendered in two-dimensional (e.g., using Flash Macromedia™) or three-dimensional graphics (e.g., using Renderware™). In various aspects, the video images are played back (e.g., from a recording stored on the gaming terminal 10), streamed (e.g., from a gaming network), or received as a TV signal (e.g., either broadcast or via cable) and such images can take different forms, such as animated images, computer-generated images, or "real-life" images, either prerecorded (e.g., in the case of marketing/promotional material) or as live footage. The format of the video images can include any format including, but not limited to, an analog format, a standard digital format, or a high-definition (HD) digital format.

The player-input or user-input device(s) 26 include, by way of example, a plurality of buttons 36 on a button panel, as shown in FIG. 1, a mouse, a joy stick, a switch, a microphone, and/or a touch screen 38 mounted over the primary display area 14 and/or the secondary display area 16 and having one or more soft touch keys 40, as is also shown in FIG. 1. In still other aspects, the player-input devices 26 comprise technologies that do not rely upon physical contact between the player and the gaming terminal, such as speech-recognition technology, gesture-sensing technology, eye-tracking technology, etc. The player-input or user-input device(s) 26 thus accept(s) player input(s) and transforms the player input(s) to electronic data signals indicative of a player input or inputs corresponding to an enabled feature for such input(s) at a time of activation (e.g., pressing a "Max Bet" button or soft key to indicate a player's desire to place a maximum wager to play the wagering game). The input(s), once transformed into electronic data signals, are output to a CPU or controller 42 (see FIG. 2) for processing. The electronic data signals are selected from a group consisting essentially of an electrical current, an electrical voltage, an electrical charge, an optical signal, an optical element, a magnetic signal, and a magnetic element.

The information reader 24 (or information reader/writer) is preferably located on the front of the housing 12 and comprises, in at least some forms, a ticket reader, card reader, bar code scanner, wireless transceiver (e.g., RFID, Bluetooth, etc.), biometric reader, or computer-readable-storage-medium interface. As noted, the information reader may comprise a physical and/or electronic writing element to permit writing to a ticket, a card, or computer-readable-storage-medium. The information reader 24 permits information to be transmitted from a portable medium (e.g., ticket, voucher, coupon, casino card, smart card, debit card, credit card, etc.) to the information reader 24 to enable the gaming terminal 10 or associated external system to access an account associated with cashless gaming, to facilitate player tracking or game customization, to retrieve a saved-game state, to store a current-game state, to cause data transfer, and/or to facilitate access to casino services, such as is more fully disclosed, by way of example, in U.S. Patent Publication No. 2003/0045354, published on Mar. 6, 2003, entitled "Portable Data Unit for Communicating With Gaming Machine Over Wireless Link," which is incorporated herein by reference in its entirety. The noted account associated with cashless gaming is, in some aspects of the present concepts, stored at an external system 46 (see FIG. 2) as more fully disclosed in U.S. Pat. No. 6,280,328 to Holch et al. entitled "Cashless Computerized Video Game System and Method," which is incorporated herein by reference in its entirety, or is alternatively stored directly on the portable storage medium. Various security protocols or features can be used to enhance security of the portable storage medium. For example, in some aspects, the individual carrying the portable storage medium is required to enter a secondary independent authenticator (e.g., password, PIN number, biometric, etc.) to access the account stored on the portable storage medium.

Figure 2:
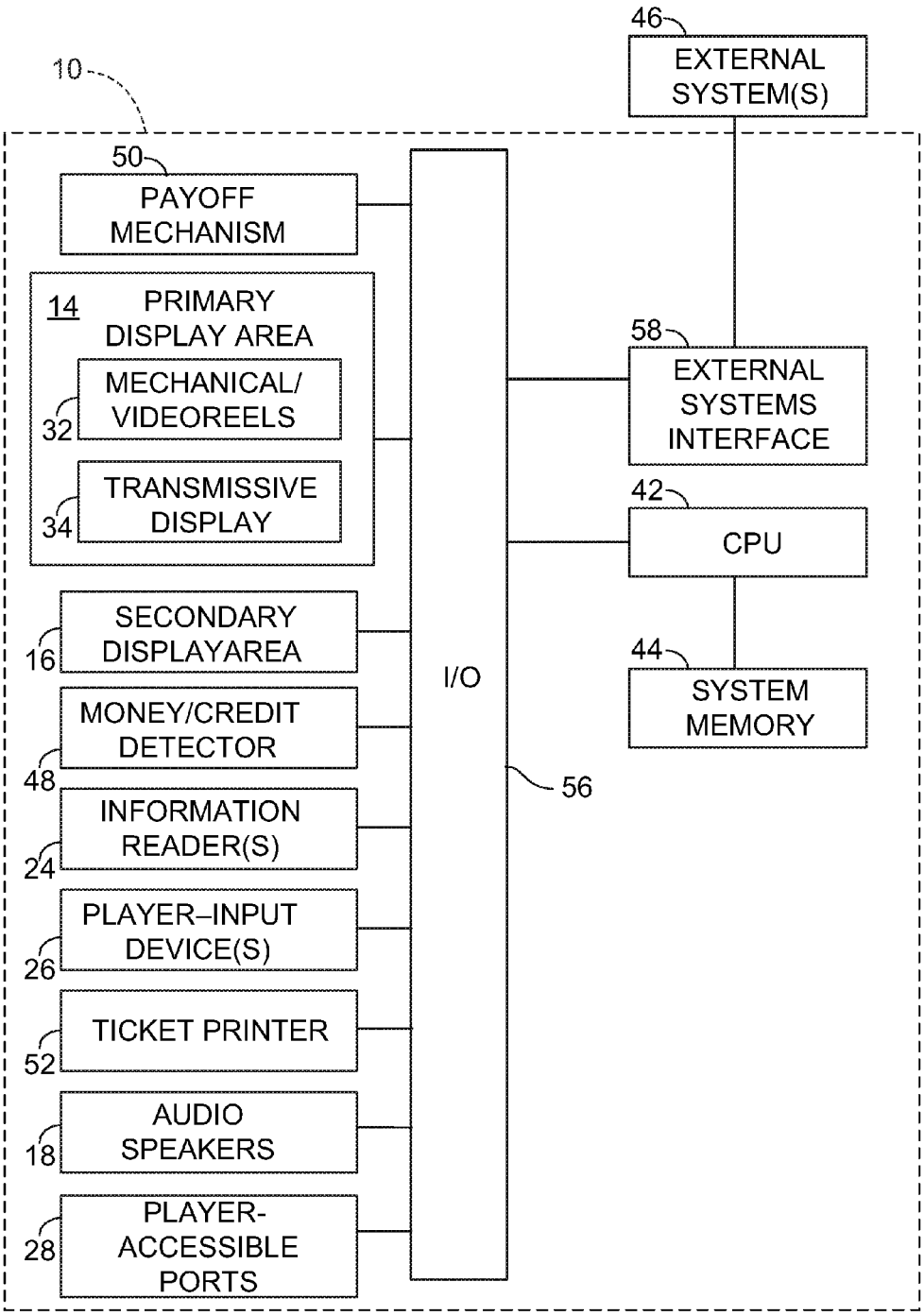
FIG.2 (Prior Art)
FIG. 2 is a schematic diagram of an exemplary gaming system according to aspects of the present disclosure.

Turning now to FIG. 2, the various components of the gaming terminal 10 are controlled by one or more processors (e.g., CPU, distributed processors, etc.) 42, also referred to herein generally as a controller (e.g., microcontroller, microprocessor, etc.). The controller 42 can include any suitable processor(s), such as an Intel® Pentium processor, Intel® Core 2 Duo processor, AMD Opteron™ processor, or UltraSPARC® processor. By way of example, the controller 42 includes a plurality of microprocessors including a master processor, a slave processor, and a secondary or parallel processor. Controller 42, as used herein, comprises any combination of hardware, software, and/or firmware disposed in and/or disposed outside of the gaming terminal 10 that is configured to communicate with and/or control the transfer of data between the gaming terminal 10 and a bus, another computer, processor, or device and/or a service and/or a network. The controller 42 comprises one or more controllers or processors and such one or more controllers or processors need not be disposed proximal to one another and may be located in different devices and/or in different locations. For example, a first processor is disposed proximate a user interface device (e.g., a push button panel, a touch screen display, etc.) and a second processor is disposed remotely from the first processor, the first and second processors being electrically connected through a network. As another example, the first processor is disposed in a first enclosure (e.g., a gaming machine) and a second processor is disposed in a second enclosure (e.g., a server) separate from the first enclosure, the first and second processors being communicatively connected through a network. The controller 42 is operable to execute all of the various gaming methods and other processes disclosed herein.

To provide gaming functions, the controller 42 executes one or more game programs comprising machine-executable instructions stored in local and/or remote computer-readable data storage media (e.g., memory 44 or other suitable storage device). The term computer-readable data storage media, or "computer-readable medium," as used herein refers to any media/medium that participates in providing instructions to controller 42 for execution. The computer-readable medium comprises, in at least some exemplary forms, non-volatile media (e.g., optical disks, magnetic disks, etc.), volatile media (e.g., dynamic memory, RAM), and transmission media (e.g., coaxial cables, copper wire, fiber optics, radio frequency (RF) data communication, infrared (IR) data communication, etc). Common forms of computer-readable media include, for example, a hard disk, magnetic tape (or other magnetic medium), a 2-D or 3-D optical disc (e.g., a CD-ROM, DVD, etc.), RAM, PROM, EPROM, FLASH-EPROM, any other memory chip or solid state digital data storage device, a carrier wave, or any other medium from which a computer can read. By way of example, a plurality of storage media or devices are provided, a first storage device being disposed proximate the user interface device and a second storage device being disposed remotely from the first storage device, wherein a network is connected intermediate the first one and second one of the storage devices.

Various forms of computer-readable media may be involved in carrying one or more sequences of one or more instructions to controller 42 for execution. By way of example, the instructions may initially be borne on a data storage device of a remote device (e.g., a remote computer, server, or system). The remote device can load the instructions into its dynamic memory and send the instructions over a telephone line or other communication path using a modem or other communication device appropriate to the communication path. A modem or other communication device local to the gaming machine 10 or to an external system 46 associated with the gaming machine can receive the data on the telephone line or conveyed through the communication path (e.g., via external systems interface 58) and output the data to a bus, which transmits the data to the system memory 44 associated with the processor 42, from which system memory the processor retrieves and executes the instructions.

Thus, the controller 42 is able to send and receive data, via carrier signals, through the network(s), network link, and communication interface. The data includes, in various examples, instructions, commands, program code, player data, and game data. As to the game data, in at least some aspects of the present concepts, the controller 42 uses a local random number generator (RNG) to randomly generate a wagering game outcome from a plurality of possible outcomes. Alternatively, the outcome is centrally determined using either an RNG or pooling scheme at a remote controller included, for example, within the external system 46.

As shown in the example of FIG. 2, the controller 42 is coupled to the system memory 44. The system memory 44 is shown to comprise a volatile memory (e.g., a random-access memory (RAM)) and a non-volatile memory (e.g., an EEPROM), but optionally includes multiple RAM and multiple program memories.

As shown in the example of FIG. 2, the controller 42 is also coupled to a money/credit detector 48. The money/credit detector 48 is configured to output a signal the controller 42 that money and/or credits have been input via one or more value-input devices, such as the bill validator 20, coin acceptor 22, or via other sources, such as a cashless gaming account, etc. The value-input device(s) is integrated with the housing 12 of the gaming terminal 10 and is connected to the remainder of the components of the gaming terminal 10, as appropriate, via a wired connection, such as I/O 56, or wireless connection. The money/credit detector 48 detects the input of valid funds into the gaming terminal 10 (e.g., via currency, electronic funds, ticket, card, etc.) via the value-input device(s) and outputs a signal to the controller 42 carrying data regarding the input value of the valid funds. The controller 42 extracts the data from these signals from the money/credit detector 48, analyzes the associated data, and transforms the data corresponding to the input value into an equivalent credit balance that is available to the player for subsequent wagers on the gaming terminal 10, such transforming of the data being effected by software, hardware, and/or firmware configured to associate the input value to an equivalent credit value. Where the input value is already in a credit value form, such as in a cashless gaming account having stored therein a credit value, the wager is simply deducted from the available credit balance.

As seen in FIG. 2, the controller 42 is also connected to, and controls, the primary display area 14, the player-input device(s) 26, and a payoff mechanism 50. The payoff mechanism 50 is operable in response to instructions from the controller 42 to award a payoff to the player in response to certain winning outcomes that occur in the base game, the bonus game(s), or via an external game or event. The payoff is provided in the form of money, credits, redeemable points, advancement within a game, access to special features within a game, services, another exchangeable media, or any combination thereof. Although payoffs may be paid out in coins and/or currency bills, payoffs are alternatively associated with a coded ticket (from a ticket printer 52), a portable storage medium or device (e.g., a card magnetic strip), or are transferred to or transmitted to a designated player account. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ front-side bus and a PCI backside bus. Although the I/O circuit 56 is shown as a single block, it should be appreciated that the I/O circuit 56 alternatively includes a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface or communication device 58, which is connected to the external system 46. The controller 42 communicates with the external system 46 via the external system interface 58 and a communication path (e.g., serial, parallel, IR, RC, 10bT, near field, etc.). The external system 46 includes, in various aspects, a gaming network, other gaming terminals, a gaming server, a remote controller, communications hardware, or a variety of other interfaced systems or components, in any combination. In yet other aspects, the external system 46 may comprise a player's portable electronic device (e.g., cellular phone, electronic wallet, etc.) and the external system interface 58 is configured to facilitate wireless communication and data transfer between the portable electronic device and the controller 42, such as by a near field communication path operating via magnetic field induction or a frequency-hopping spread spectrum RF signals (e.g., Bluetooth, etc.).

The gaming terminal 10 optionally communicates with external system 46 (in a wired or wireless manner) such that each terminal operates as a "thin client" having relatively less functionality, a "thick client" having relatively more functionality, or with any range of functionality therebetween (e.g., an "intermediate client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external systems 46 ("thin client" gaming terminal), or are distributed therebetween in any suitable manner ("intermediate client" gaming terminal).

Figure 3:
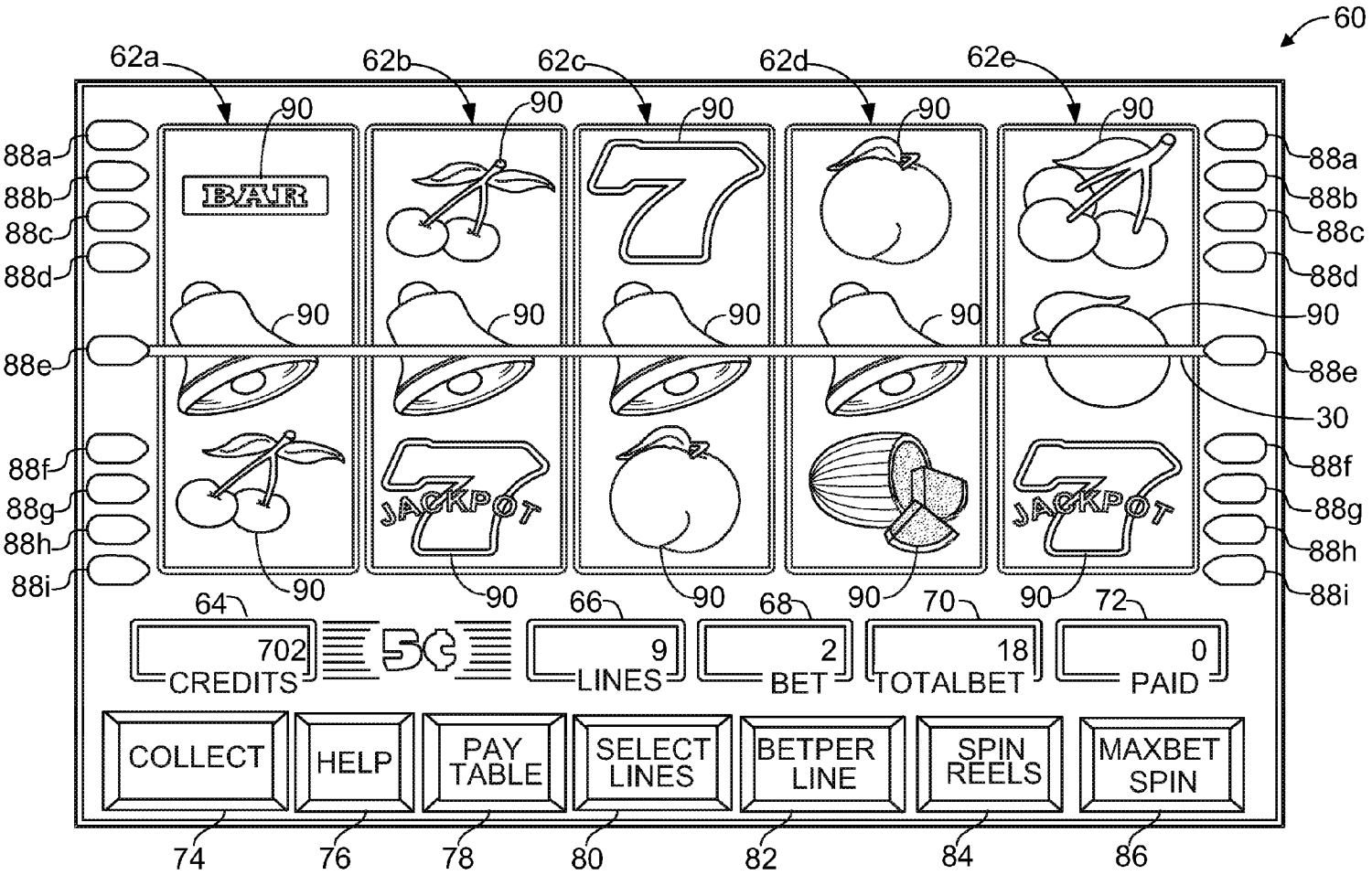
FIG.3 (Prior Art)
FIG. 3 is a screen shot of a basic-game screen from an exemplary wagering game that can be played, for example, on the gaming terminal of FIG. 1 or the gaming system of FIG. 2.

Referring now to FIG. 3, an image of a basic-game screen 60 adapted to be displayed on the primary display area 14 is illustrated, according to one embodiment of the present disclosure. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

In accord with various methods of conducting a wagering game on a gaming system in accord with the present concepts, the wagering game includes a game sequence in which a player makes a wager, such as through the money/credit detector 48, touch screen 38 soft key, button panel, or the like, and a wagering game outcome is associated with the wager. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 14) through the display of information such as, but not limited to, text, graphics, text and graphics, static images, moving images, etc., or any combination thereof. In accord with the method of conducting the wagering game, the controller 42, which comprises one or more processors, transforms a physical player input, such as a player's pressing of a "Spin Reels" soft key 84 (see FIG. 3), into an electronic data signal indicative of an instruction relating to the wagering game (e.g., an electronic data signal bearing data on a wager amount).

In the aforementioned method, for each data signal, the controller 42 is configured to processes the electronic data signal, to interpret the data signal (e.g., data signals corresponding to a wager input), and to cause further actions associated with the interpretation of the signal in accord with computer instructions relating to such further actions executed by the controller. As one example, the controller 42 causes the recording of a digital representation of the wager in one or more storage devices (e.g., system memory 44 or a memory associated with an external system 46), the controller, in accord with associated computer instructions, causing the changing of a state of the data storage device from a first state to a second state. This change in state is, for example, effected by changing a magnetization pattern on a magnetically coated surface of a magnetic storage device or changing a magnetic state of a ferromagnetic surface of a magneto-optical disc storage device, a change in state of transistors or capacitors in a volatile or a non-volatile semiconductor memory (e.g., DRAM), etc.). The noted second state of the data storage device comprises storage in the storage device of data representing the electronic data signal from the controller (e.g., the wager in the present example). As another example, the controller 42 further, in accord with the execution of the instructions relating to the wagering game, causes the primary display 14 or other display device and/or other output device (e.g., speakers, lights, communication device, etc.), to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by the RNG) that is used by the controller 42 to determine the outcome of the game sequence, using a game logic for determining the outcome based on the randomly generated number. In at least some aspects, the controller 42 is configured to determine an outcome of the game sequence at least partially in response to the random parameter.

The basic-game screen 60 is displayed on the primary display area 14 or a portion thereof. In FIG. 3, the basic-game screen 60 portrays a plurality of simulated movable reels 62*a-e*. Alternatively or additionally, the basic-game screen 60 portrays a plurality of mechanical reels or other video or mechanical presentation consistent with the game format and theme. The basic-game screen 60 also advantageously displays one or more game-session meters and various buttons adapted to be actuated by a player.

In the illustrated embodiment of FIG. 3, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The depicted user-selectable buttons include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present disclosure does not require them and can be used on gaming terminals having more, less, or different player inputs.

As shown in the example of FIG. 3, paylines 30 extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations are evaluated in accord with various schemes such as, but not limited to, "line pays" or "scatter pays." Line pays are evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present disclosure. Additionally, though an embodiment with five reels is shown in FIG. 3, different embodiments of the gaming terminal 10 comprise a greater or lesser number of reels in accordance with the present disclosure.

Figure 4:
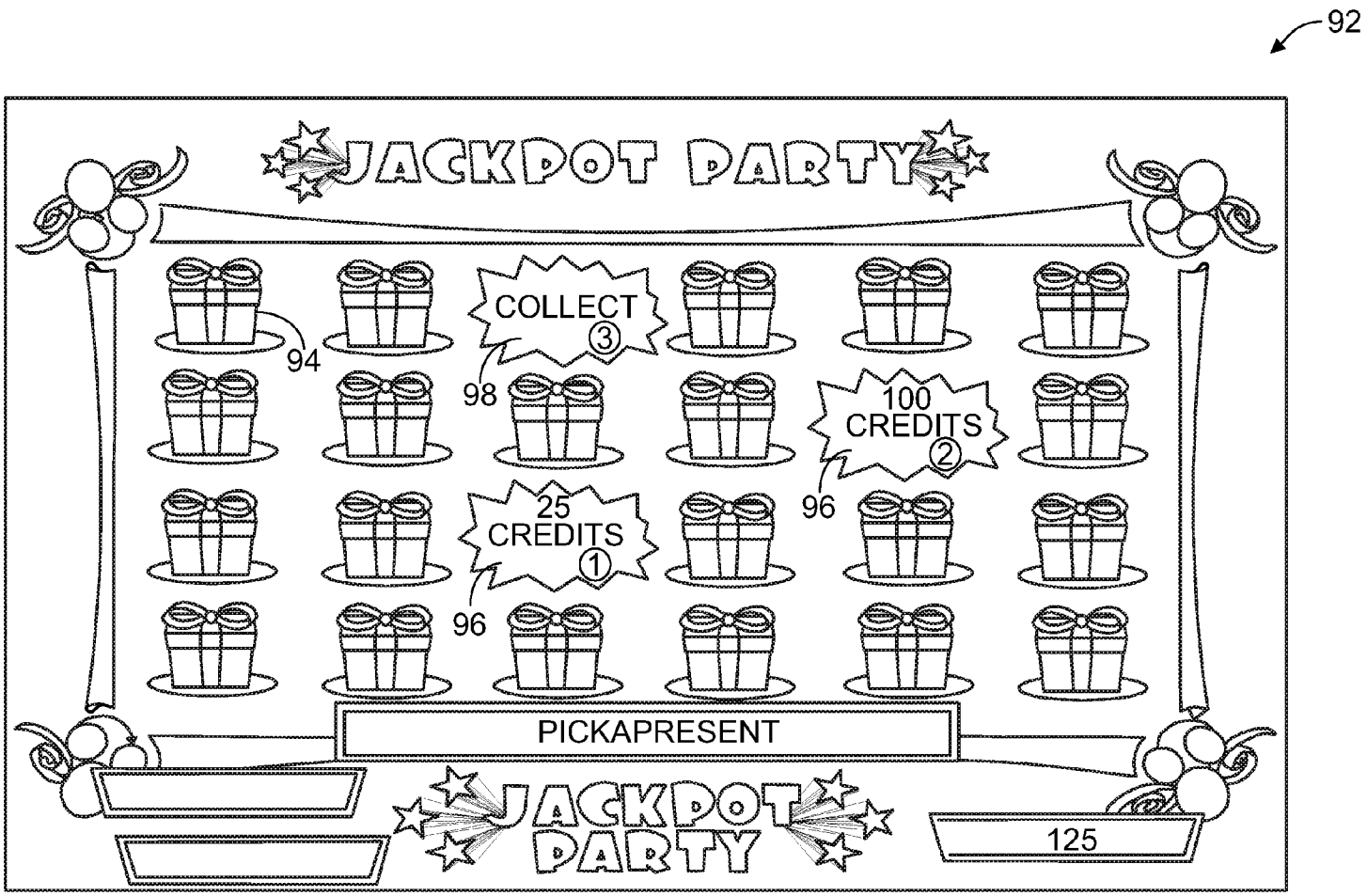
FIG.4 (Prior Art)
FIG. 4 is a screen shot of a secondary- or bonus-game screen from an exemplary wagering game that can be played, for example, on the gaming terminal of FIG. 1 or the gaming system of FIG. 2.

Turning now to FIG. 4, an example of a bonus game to a basic wagering game is illustrated. A bonus-game screen 92 includes an array of markers 94 located in a plurality of columns and rows. The bonus game is entered upon the occurrence of a triggering event, such as the occurrence of a start-bonus game outcome (e.g., symbol trigger, mystery trigger, time-based trigger, etc.) in or during the basic wagering game. Alternatively, any bonus game described herein is able to be deployed as a stand-alone wagering game independent of a basic wagering game.

In the illustrated bonus game of FIG. 4, a player selects, one at a time, from the array of markers 94 to reveal an associated bonus-game outcome. According to one embodiment of this bonus game, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Figure 5:
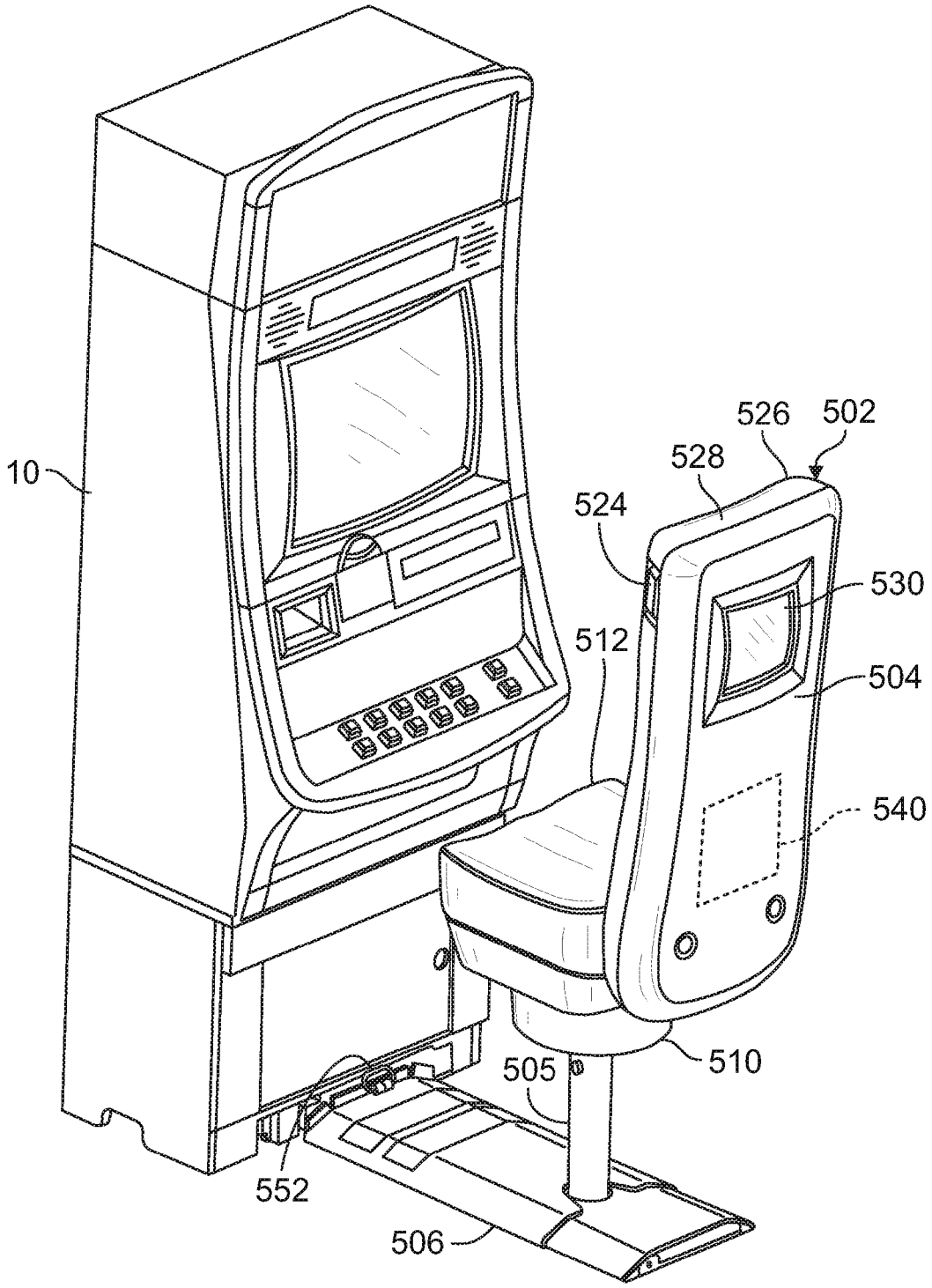
FIG. 5 provides a perspective view illustration of a gaming system having a chair coupled to a front of the gaming terminal.

FIG. 5 provides a perspective view illustration of a gaming system 500 having a chair 502 coupled to a front of the gaming terminal 10. Although differing in appearance, the gaming terminal 10 shown in FIG. 5 can be similar in function, operation and connectivity to the gaming terminal 10 discussed above with respect to FIGS. 1 and 2. In the system 500 the chair 502 is positioned in front of the gaming terminal 10 such that a player can sit in front of the gaming terminal while playing the wagering game provided thereon. The chair 502 includes a chair back 504, a seat 512, a bottom cover 510, a seat post 505, and a sled assembly 506. The bottom cover 510 is positioned underneath the seat 512, and in some implementations houses a swivel for allowing the chair 502 to rotate. The sled assembly 506 allows the chair 502 to be urged away from and toward the gaming terminal 10 and can include, for example, wheels to allow the chair 502 to roll. The seat post 505 extends vertically from the sled assembly 506 to supports the seat 512. The chair 502 is coupled to the gaming terminal 10 via a latching device (further described in connection with FIGS. 6 and 7) located on the sled assembly 506. The latching device can be released with the release handle 552 to allow the chair 502 to be physically and mechanically decoupled from the gaming terminal 10. In some implementations, the sled assembly 506 is configured to allow the chair 502 to slide away from the gaming terminal 10 after releasing the latching device via the release handle 552.

Figure 7A:
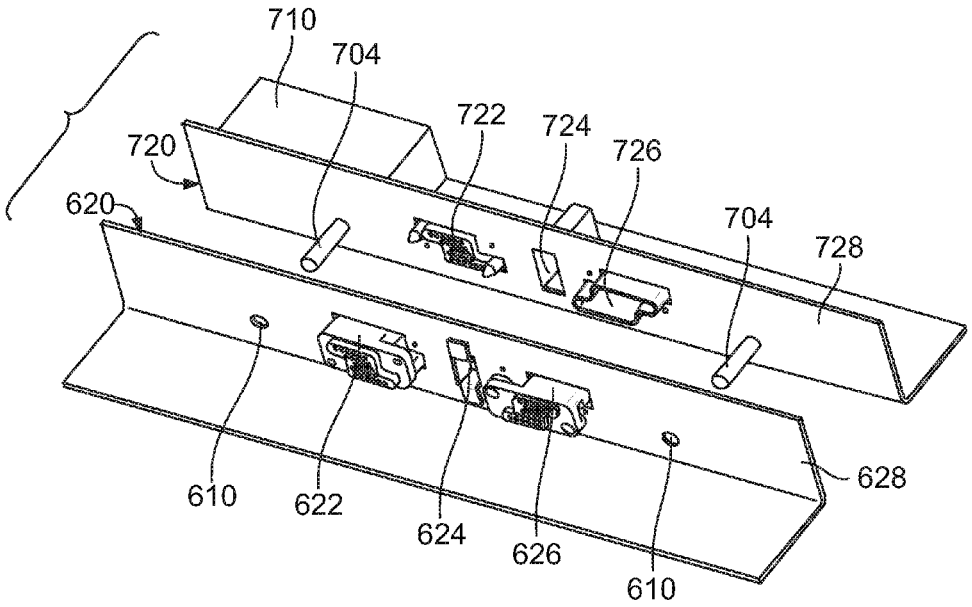
FIG. 7A provides a view of both the electrical connector assembly of the gaming terminal and the complementary electrical connector assembly of the chair.

The chair 502 also includes electronic components powered by an alternating current (AC) power supply (e.g. via the power entry module 710 of FIG. 7A). The electronic components can be housed within, mounted to, or otherwise attached to the seat 512, the chair back 504, or other aspects of the chair 502. In example implementations, the electronic components include, without limitation, a left speaker 524, right speaker 526, a subwoofer 528, a display screen 530, a motion generating apparatus 540, and any combination or subset thereof. The speakers 524, 526, 528 can provide a surround sound experience for a user sitting on the chair 502. The display screen 530 can be a flat screen display screen such as a display screen utilizing plasma, LCD, or LED technologies, and can be mounted to the back portion of the chair back 504 such that passerbys and prospective players of the wagering game can view information displayed on the display screen 530. The motion generating apparatus 540 can include hydraulicly driven and/or inductive motor driven components for moving aspects of the chair 502. The movement provided by the motion generating apparatus 540 can be motions that displace aspects of the chair, or adjust, for example, an amount of reclining, an elevation, a lumbar support, a side-to-side or back-and-forth position of the chair, etc. In addition, the motion generating apparatus 540 can cause portions of the chair 502 to vibrate to provide a tactile stimulation to a player of the wagering game. In implementations, the motion created in the chair 502 by the motion generating apparatus 540 can enhance a player's experience when playing the wagering game on the gaming terminal 10 by providing motions related to events, outcomes, and/or conditions in the wagering game. Additionally or alternatively the chair 502 can include additional sound-generating components or visually stimulating components, such as display lights, marquees, etc.

The chair 502 can also include electronic components for sending output signals, such as digital signals, to the gaming terminal 10, such as, for example, one or more input devices (e.g., buttons, touchscreens, or switches) for receiving inputs from players sitting in the chair 502 and/or one or more sensors for detecting whether the chair 502 is occupied or for detecting a position of the chair 502. In an implementation, the position of the chair 502 can be automatically adjusted via the motion generating apparatus 540 based on information received from the sensors within the chair 502, which can provide information indicative of, for example, height and weight of an occupant of the chair 502.

To power the electronic components associated with the chair 502 (e.g. the speakers 524, 526, 528, the display screen 530, the motion generating apparatus 540, etc.) electrical cables are passed from the gaming terminal 10 to within the chair 502. For example, in implementations having speakers (such as the speakers 524, 526, 528) the electrical cables can include speaker cables for providing audio signals to the speakers. In implementations having electronic components requiring both alternating current (AC) power signals ("primary voltage signals") to provide AC power and digital data signals ("secondary voltage signals") to provide programmatic inputs, the electrical cables can include conductors of both AC power signals and digital data signals. The electrical cables can generally pass through the sled assembly 506 up the seat post 505 and into the seat 512 and chair back 504 where they are connected to the electronic components mounted therein. In addition, while the electrical cables are described as plural, implementations of the present disclosure can optionally utilize a single electrical cable to simultaneously conduct, via separate conductors, the AC power signals and the digital data signals.

In an implementation, the AC power signals and digital data signals are delivered to the chair 502 from the gaming terminal 10. The signals pass between the gaming terminal 10 and the chair 502 through a pair of electrical connector assemblies described further herein. By coupling together the electrical connector assemblies, AC power signals and digital data signals can be connected to the electronic components within the chair 502.

While FIG. 5 illustrates one implementation of the chair 502, implementations of the chair 502 are not so limited and can optionally include arm rests, footrests, headrests, etc. Furthermore, implementations of the chair 502 may be realized without the seat post 505, such as an implementation where the bottom of the seat 512 is mounted directly to the sled assembly 506. In addition, the motion generating apparatus 540 can be implemented so as to move any additional aspects of the chair 502 not illustrated in FIG. 5.

Figure 6:
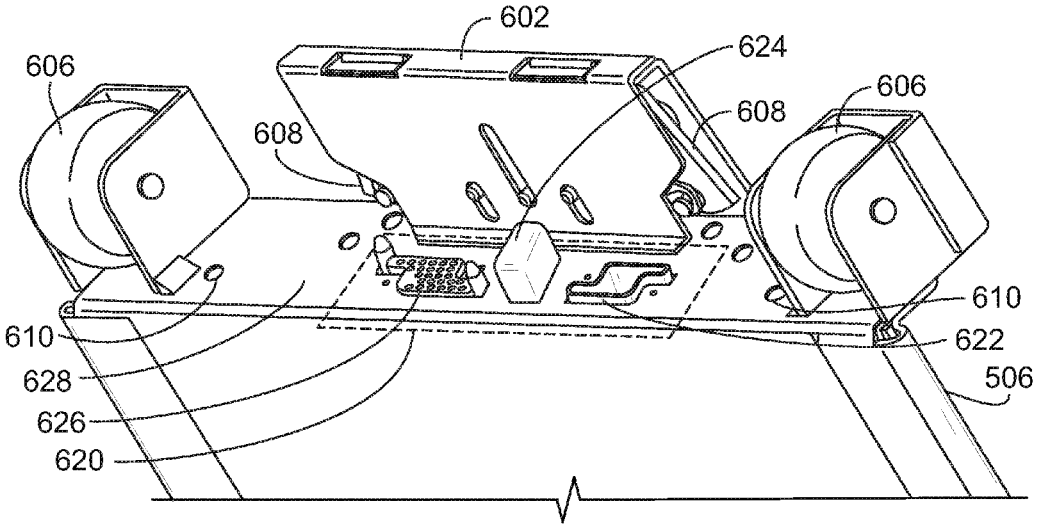
FIG. 6 illustrates an exemplary implementation of the complementary electrical connector assembly mounted to the sled assembly on a portion of the sled assembly adapted for mechanically coupling to the base of the gaming terminal.

FIG. 6 illustrates an exemplary implementation of the complementary electrical connector assembly 620 mounted to the sled assembly 506 on a portion of the sled assembly 506 adapted for mechanically coupling to the base of the gaming terminal 10. The sled assembly 506 includes a pair of wheels 606 for allowing the sled assembly 506 to be rolled toward and away from the gaming terminal 10. In an implementation, the wheels 606 are mounted to a pair of commonly aligned axis pins as shown in FIG. 6. The sled assembly 506 also includes a latching device 602 for securing the mechanical coupling between the sled assembly 506 and the gaming terminal 10. The latching device 602 includes cams 608 for connecting to a mating connector on the gaming terminal 10. The cams 608 are spring loaded so that when the cams 608 are pushed in for connection to the mating connector of the gaming terminal 10, the cams 608 retract. The cams 608 then push out after the connection is complete to secure the connection. The release handle (552 shown in FIG. 5) can be pulled to release the cams 608 and thereby disengage (mechanically decouple) the sled assembly 506 from the gaming terminal 10.

The complementary electrical connector assembly 620 includes a plurality of apertures 610 for receiving corresponding alignment pins (704 shown in FIG. 7A) of the electrical connector assembly (720 shown in FIG. 7A) mounted on the gaming terminal 10. The complementary electrical connector assembly 620 also includes a power circuit female connector 622, a power switch activator 624, and a digital data circuit male connector 626. The power circuit female connector 622 is a female multi-pin electrical connector having a plurality of electrical terminals. The digital data circuit 626 is a male multi-pin electrical connector having a plurality of electrical terminals. The power switch activator 624 can be a protrusion from a metallic base plate 628 of the complementary electrical connector assembly 620. The power switch activator 624 can be integrally formed with, or securely attached to, the metallic base plate 628. As will be described further below in connection with FIGS. 7A-9, the dimensions of the power switch activator 624 can be selected to allow for the power switch activator 624 to engage an associated switching device (such as the switching device 724 further described in connection with FIGS. 7A through 8B) after the electrical connector assembly (720 in FIG. 7A) is securely coupled with (e.g. mated with) the complementary electrical connector assembly 620.

FIG. 7A provides a view of both the electrical connector assembly 720 of the gaming terminal 10 and the complementary electrical connector assembly 620 of the chair 502. The electrical connector assembly 720 includes the alignment pins 704, a power circuit male connector 722, a switching device 724, a digital data circuit female connector 726, and a metallic base plate 728. The power circuit male connector 722 is a multi-pin electrical connector having a plurality of electrical terminals corresponding to, and adapted for coupling with, the plurality of electrical terminals of the power circuit female connector 622. The digital data circuit female connector 726 is a multi-pin electrical connector having a plurality of electrical terminals corresponding to, and adapted for coupling with, the plurality of electrical terminals of the digital data circuit male connector 626. The switching device ("power activation switch") 724 is an electrical switch for switchably connecting a power entry module 710 to the power circuit male connector 722. For example, the switching device 724 can be a plunger-type electrical switch having a depressible member outwardly biased in an "off" position of the switching device 724 (e.g. the switch is open). The switching device 724 can be configured to be moved to an "on" position (e.g. the switch is closed) when the depressible member of the switching device 724 is depressed. The switching device 724 is positioned such that the switch activator 624 is aligned to depress the depressible member of the switching device 724 and thereby connect the AC power entry module 710 to the power circuit male connector 722.

The power entry module 710 can include a receptacle for a power cord to detachably couple the power entry module 710 to an AC power line carrying AC power signals. The power entry module 710 can also incorporate shielding and/or filters to decrease electromagnetic interference ("EMI") and radio frequency interference ("RFI") associated with the AC power signals. The power entry module 710 can also include one or more conductive terminals for coupling the power entry module 710 to aspects of the electrical connector assembly 720 (such as the power circuit male connector 722) and allowing the AC power signals be conveyed to the electrical connector assembly 720.

In an exemplary operation of the respective electrical connector assemblies 550, 620 shown in FIG. 7A, the chair 502 is urged toward the gaming terminal 10. By urging the chair 502 toward the gaming terminal 10, the complementary electrical connector assembly 620 mounted to the sled assembly 506 of the chair 502 slides toward the electrical connector assembly 550 mounted to the gaming terminal 10. For example, the chair 502 can slide by rolling along a path toward the gaming terminal via the wheels 606. As the chair 502 approaches the gaming terminal 10, the alignment pins 704 from the electrical connector assembly 720 are received by the corresponding apertures 610 of the complementary electrical connector assembly 620. With the alignment pins 704 partially inserted in the corresponding apertures 610, the chair 502 continues to be urged toward the gaming terminal 10 and the power circuit male and female connectors 622, 722 and digital data circuit male and female connectors 626, 726 are each securely coupled (e.g. physically mated) to one another.

The connectors 622, 722, 626, 726 can each be blind-mate connectors adapted for being pushed together without being felt or seen by a user. The connectors 622, 722, 626, 726 can include fine alignment features to further align the connectors and correct small mis-alignments even after the alignment pins 704 are partially inserted in the corresponding apertures 610. With the connectors 622, 722, 626, 726 each securely coupled (e.g. physically mated) to one another such that the respective plurality of electrical terminals within each of the connectors is coupled to its corresponding electrical terminal, the switch activator 624 engages the switching device 724 and thereby causes the power entry module 710 to be electrically coupled to the electronic components within the chair 502. In implementations, the switch activator 624 can be a protrusion from the metallic base plate 628 of the complementary electrical connector assembly 620 having a dimension such that a biased depressible member of the switching device is not engaged to close (turn on) the switching device 724 until the connectors 622, 722, 626, 726 and their respective plurality of electrical terminals are securely coupled to one another. By closing the switching device 724 via the switch activator 624, the AC power signals from the power entry module 710 are conveyed through the power circuit male connector 722, through the power circuit female connector 622, and then through electrical cables to the electronic components within the chair 502 requiring power from the power entry module 710.

The alignment pins 704 advantageously provide alignment between the electrical connector assemblies 720, 620 by ensuring that the electrical connector assemblies 720, 620 are mated when the alignment pins 704 are received by the corresponding apertures. The connector assemblies 720, 620 may also be aligned via additional alignment features (e.g. the alignment features 740, 741 of FIG. 7B). The alignment pins 704 can be made of metal or another rigid material. In implementations where the alignment pins 704 are made of metal or another conductive material, the alignment pins can allow for the discharge of any electrostatic energy between the metallic base plate 728 of the electrical connector assembly 720 and the metallic base plate 628 of the complementary electrical connector assembly 620. By discharging electrostatic energy between the gaming terminal 10 and the chair 502 prior to electrically coupling the multi-pin connectors (e.g. 622, 722 and 626, 726), the subsequent electrical coupling between the chair 502 and the gaming terminal 10 is less likely to produce an electrical arc. While the metallic base plates 628, 728 are described as metallic, and are advantageously formed from a conductive material to provide for the discharge of electrostatic energy, the present disclosure is not so limited and the metallic base plates 628, 728 can each be created from another rigid material such as wood, plastic, or the like.

Both the electrical connector assembly 720 and the corresponding electrical connector assembly 620 are each shown having a male multi-pin connector (e.g. 626, 722) and female multi-pin connector (e.g. 622, 726) in FIG. 7A. In an arrangement such as the one shown in FIG. 7A where each electrical connector assembly 720, 620 has both a male and female connector, the respective electrical connector assemblies 720, 620 are more readily assembled in a correct configuration. Errors in a desired arrangement of the respective electrical connector assemblies 720, 620 are also more readily detectable with alternating male and female connector arrangement because the assemblies only fit together in one way. Alternating the male and female connectors as between the power circuit connectors 622, 722 and the digital data circuit 626, 726 also advantageously prevent a user from accidentally coupling a connector of the digital data circuit to a connector of the power circuit, which could potentially harm the electronic components in the chair 502. However, the present disclosure is in no way limited to electrical connector assemblies having both male and female connectors, to electrical connector assemblies incorporating blind-mate connectors, or to the use of alternating male and female electrical connectors.

Arrangements described herein in connection with FIGS. 6 and 7A generally illustrate the power circuit connectors 622, 722 as distinct and separate from the digital data circuit connectors 626, 726. This non-limiting arrangement can provide an isolation feature such that distortion and interference generated by the power circuit (e.g. by the power entry module 710 and/or the associated electrical cables 804) are isolated from the digital data circuit. Isolating the power circuit can be achieved in part by placing the power entry module 710 at a location where interfering signals emanating therefrom avoid the digital data circuit, such as a location near the electrical connector assembly 720 as shown in FIG. 7A. The use of separate connectors for the power circuit (e.g. the connectors 622, 722) from the digital data circuit connectors (e.g. 626, 726) offers advantages to mitigate interference from the power supply signals and prevent accidental connection between the power circuit and digital data circuit. However, the present disclosure is in no way limited to such configurations. For example, the electrical connector assembly 720 can have a single multi-pin connector having terminals coupled to both digital data signals and AC power signals. Likewise, the complementary electrical connector assembly 620 can be implemented as a single multi-pin connector adapted to mate with the electrical connector assembly 720 and having some terminals delivering digital data signals and some delivering AC power signals to aspects within the chair 502. Additionally or alternatively, noise and distortion in the digital signals (e.g. 830 in FIG. 8A) from electrical interference due to the power circuit can also be mitigated through the use of shielding and circuit and wiring layout as will be appreciated by those skilled in the art.

Furthermore, while the switching device 724 is described occasionally as having a depressible member biased in an off position of the switching device 724 and adapted to be depressed to an on position of the switching device 724 by the switch activator 624, the present disclosure is not limited to switching devices operating according to a plunger-type electrical switch biased in an off position. For example, the function of the switch activator 624, which activates the switching device 724 once the connectors 622, 722 are securely coupled, can be replaced by a proximity sensor such as an electrical contact sensor or other distance or ranging measurement system that provides an instruction to the switching device 724. In addition, as will be further described in connection with the circuit block diagram shown in FIGS. 8B, the switching device 724 may be implemented as a relay circuit receiving feedback signals indicating that the connectors 622, 722 are securely coupled. Implementations where the switching device 724 is implemented as a relay circuit may also disconnect the power entry module 710 according to switching signals that are provided by the gaming terminal 10. The switching signals may be generated in response to detecting a secure connection between the respective connectors (e.g. 622, 722) and may be provided after a pre-programmed time delay. In addition, the switching signals may be generated according to a condition unrelated to the coupling between the respective connectors (e.g. 622, 722).

Figure 7B:
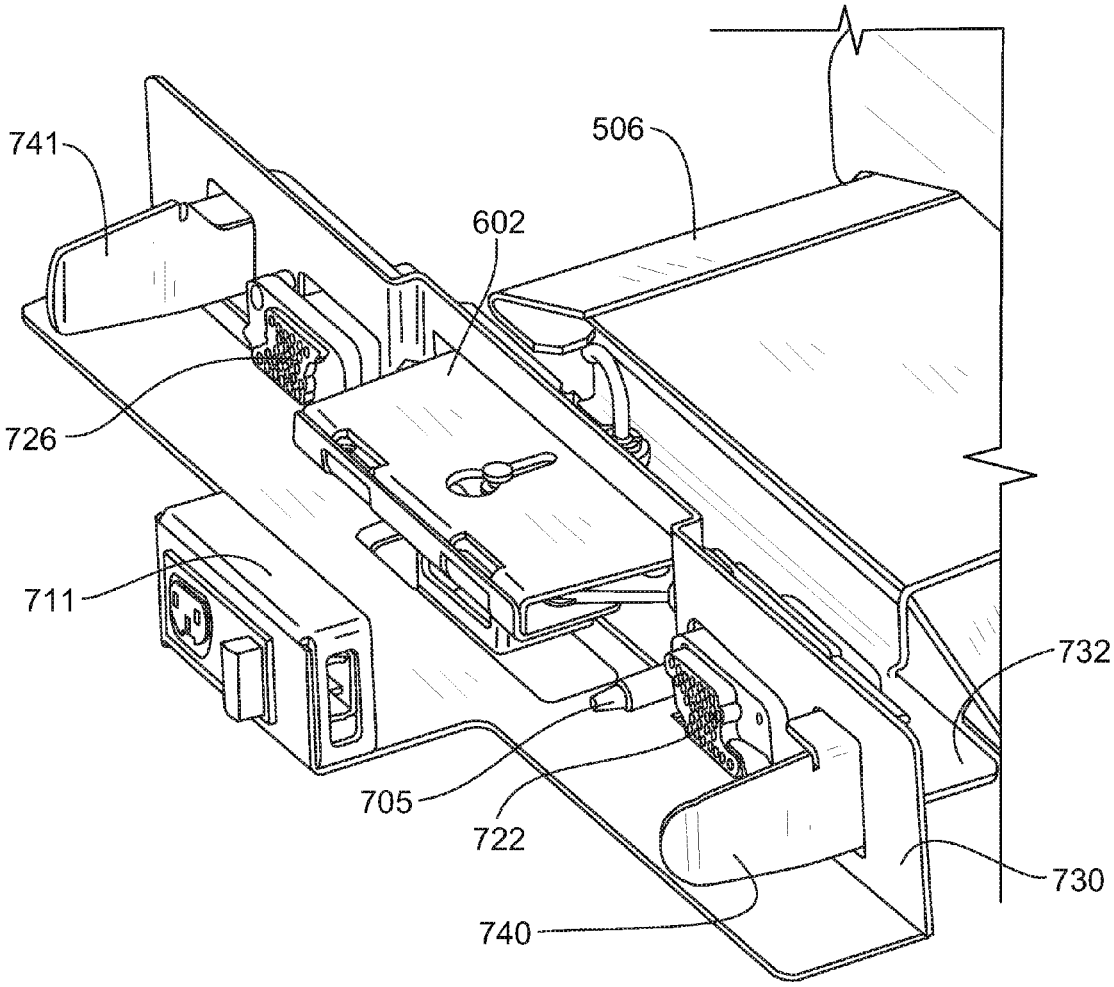
FIG. 7B provides an aspect view of an alternate arrangement of the electrical connector assembly of the gaming terminal and the complementary electrical connector assembly of the chair incorporating alignment features providing additional vertical and lateral alignment.
Figure 7C:
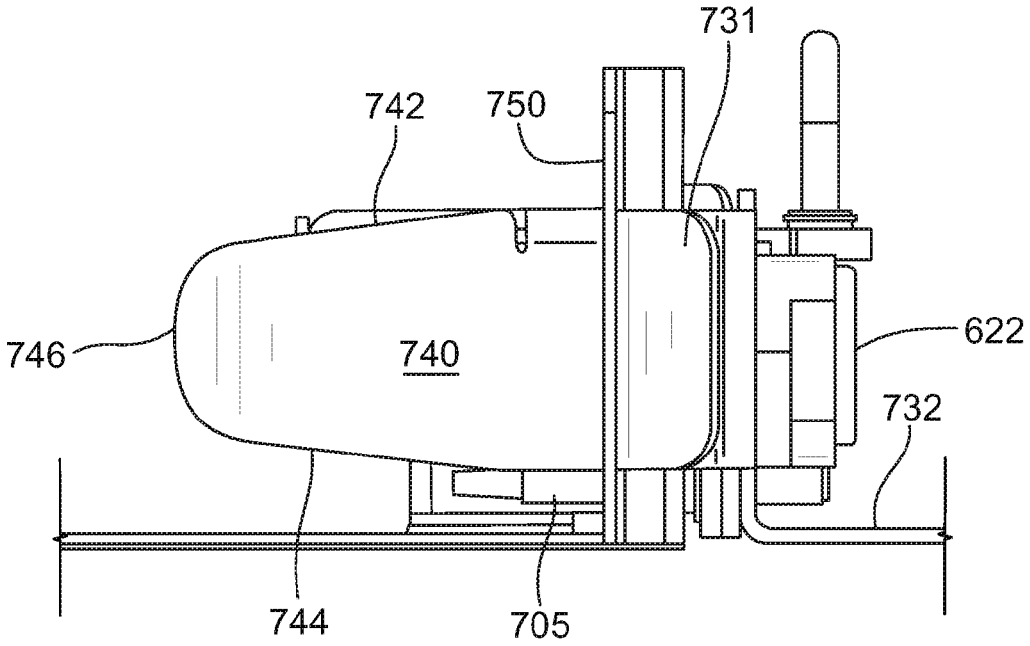
FIG. 7C provides a side view of a first alignment feature.

FIG. 7B provides an aspect view of an alternate arrangement of the electrical connector assembly 720 of the gaming terminal 10 and the complementary electrical connector assembly 620 of the chair 502 incorporating alignment features or components 740, 741 providing additional vertical and lateral alignment. In the arrangement shown in FIG. 7B, the respective electrical connector assemblies 720, 620 are securely mated together, and the view illustrates a back side of the electrical connector assembly 720 of the gaming terminal 10. The electrical connector assembly 720 of the gaming terminal 10 is arranged with the connectors 722, 726 mounted to a baseplate 730. The connectors 722, 726 are positioned on either side of an interface with the latching device 602. The baseplate 730 includes openings for receiving the alignment features 740, 741 the conical alignment pins 705, and the latching device 602. The complementary electrical connector assembly 620 and the latching device 602 are mounted to a baseplate 732 associated with the sled 506 of the chair 502. An example power entry module 711 is also illustrated mounted within the gaming terminal 10. In an implementation, the power entry module 711 can be switchably coupled to the power circuit male connector 722 such that AC power supply signals flow into the chair 502 once the power circuit connectors 722, 622 are securely mated. While the general arrangement shown for the respective electrical connector assemblies 720, 620 and associated alignment features 740, 741, and 705 may differ from arrangements illustrated elsewhere, the arrangement in FIG. 7B incorporates aspects discussed herein to automatically connect and disconnect AC power supply signals to electronic components associated with the chair 502.

In a gaming establishment, such as a casino, the gaming terminal 10 and the chair 502 may rest on carpet. Under such conditions, vertical mis-alignment between the electrical connector assemblies 720, 620 can occur. In addition, it is desirable to allow for automatic lateral alignment of the connector assemblies during a mating operation to allow for greater ease of use. The alignment features 740, 741 provide macro-vertical and macro-lateral alignment during a mating operation when the chair 502 is urged toward the gaming terminal 10. The alignment features can be integrally formed with the baseplate 732, or can be securely coupled thereto by, for example, fasteners. The alignment features 740, 741 can be formed of metal, plastic, or another rigid material suitable for transferring mechanical forces. The features 740, 741 are configured to engage openings and/or angled portions of the baseplate 730 and thereby adjust the lateral and/or vertical alignment of the complementary electrical connector assembly 620 of the chair 502 with respect to the electrical connector assembly 720 of the gaming terminal 10. The alignment features 740, 741 are advantageously proportioned such that during a mating operation, the alignment features 740, 741 engage the baseplate 730 prior to other aspects associated with the chair 502. By configuring the alignment features 740, 741 to engage the baseplate 730 first, the alignment features 740, 741 can provide a crude or macro alignment between the electrical connector assemblies 720, 620 prior to a fine alignment, which may be carried out via additional components, such as, for example, the conical alignment pins 705.

Figure 7D:
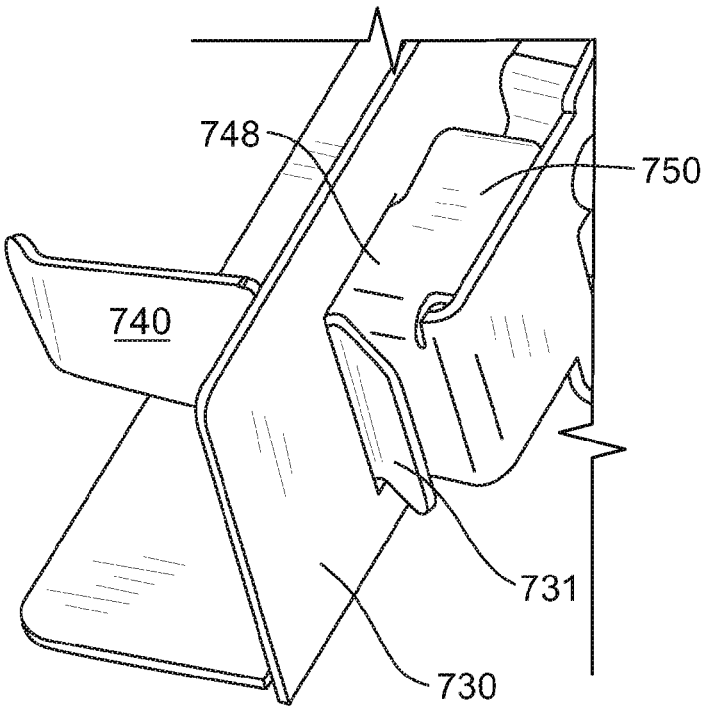
FIG. 7D provides a top aspect view of the first alignment feature.

In the arrangement shown in FIG. 7B, a first alignment feature 740 is a mirror image of a second alignment feature 741. The alignment features 740, 741 are vertically tapered to a rounded end to allow for vertical alignment. In addition, the ends of the alignment features 740, 741 are both bent inwardly to allow for lateral alignment. The first alignment feature 740 is further illustrated in FIGS. 7C and 7D, which provide a side view and a top aspect view, respectively. The first alignment feature 740 includes a top tapered side 742, a bottom tapered side 744, and a rounded end 746. The top tapered side 742 tapers toward the rounded end 746 and interfaces with a top portion of an opening through the base plate 730 to lower the chair 502 (and/or raise the gaming terminal 10) as necessary during a mating operation. The bottom tapered side 744 tapers toward the rounded end 746 and interfaces with a bottom surface of the opening through the baseplate 730 to raise the chair 502 (and/or lower the gaming terminal 10) as necessary during a mating operation. As seen in FIG. 7D, the rounded end 746 can be bent inward (i.e., toward the center of the baseplate 730) at an angle similar to the angle presented by an angled portion 731 adjacent to the opening through the baseplate 730. The angled portion 731 can be integrally formed with, or securely connected to, the baseplate 730. The second alignment feature 741 includes a rounded end that is also bent inward toward the center of the baseplate 730. During a mating operation, the rounded end 746 of the first alignment feature 740 interfaces with the angled portion 731 to provide a lateral alignment between the chair 502 and the gaming terminal 10. For example, in the event of a misalignment between the chair 502 and the gaming terminal 10, the first alignment feature 740 can interface with the angled portion 731 to urge the chair 502 rightward as necessary, while the second alignment feature 741 can interface with a suitable angled portion (not visible) to urge the chair 502 leftward as necessary.

While the arrangement in FIG. 7B illustrates two vertical and lateral alignment features on either side of the electrical connectors 622, 626 of the complementary electrical connector assembly 620, implementations according to the present disclosure are not so limited. One or more alignment features may generally be included on the complementary electrical connector assembly 620 of the chair 502 or the electrical connector assembly 720 of the gaming terminal 10, or both. Alignment features may be coupled to either the chair 502 or the gaming terminal 10 and aligned to interface with receiving aspects to provide alignment between the connector assemblies 720, 620 during a mating operation. The alignment features may be tapered vertically and/or laterally or may be angled or bent vertically and/or laterally and may be configured to interface with openings and/or angled aspects to provide alignment between the connector assemblies 720, 620 during a mating operation.

As shown in FIG. 7D, the alignment feature 740 can also include vertical and for/aft stops (relative to the gaming terminal 10) to prevent damage to the connectors (e.g. 622, 722) and other components. A for/aft stop 750 is located near a portion of the first alignment feature 740 opposite the rounded end 746. The for/aft stop 750 is aligned such that the for/aft stop 750 abuts a surface of the baseplate 730 when the alignment feature 740 passes through the opening of the baseplate. The for/aft stop can be integrally formed with the baseplate 732 or can be securely coupled thereto by fasteners or the like. The for/aft stop 750 can prevent the connector assemblies 720, 620 from being forced against one another so as to damage them, which can occur, for example, if a user pushes the chair 502 into the gaming terminal 10 with too much force. The for/aft stop 750 prevents damage by abutting the baseplate 730 and preventing the chair 502 (and associated connectors) from being pushed against the gaming terminal 10 any further. A vertical stop 748 is located near a top of a portion of the first alignment feature 740 opposite the rounded end 746. The vertical stop 748 is aligned such that the vertical stop 748 abuts a top portion of the opening through the baseplate 730 when the alignment feature 740 passes through the opening of the baseplate 730. The vertical stop 748 prevents the connector assemblies 720, 620 from being damaged by resisting forces urging the baseplate 732 of the chair 502 upward with respect to the baseplate 730 of the gaming terminal 10. The vertical stop 748 therefore prevents potential damage associated with stresses on the electrical connector assemblies 720, 620 created by a user leaning back in the chair 502 to create torque urging the baseplate 732 upward.

In an implementation, the combination of the latching device 602 and the stops 748, 750 (and similar stops on additional alignment features) combine to rigidly couple the chair 502 to the gaming terminal 10 and secure the connection in multiple dimensions. For example, the latching device 602 resists forces pulling the chair 502 away from the gaming terminal 10, while the for/aft stop 750 resist forces pushing the chair 502 in to the gaming terminal 10. In addition, the vertical stop 748 and the alignment features 740, 741 resist forces urging the chair 502 vertically and laterally with respect to the gaming terminal 10.

The arrangement illustrated in FIG. 7B also includes conical alignment pins 705 (a second conical alignment pin is not visible behind the latching device 602). The conical alignment pins 705 are an alternative configuration of the alignment pins 704 previously described. The conical alignment pins 705 have a tapered shape such that a cross-section through a distal end of the conical alignment pin 705 has a smaller area than a cross-section through a proximate end of the conical alignment pin 705. The conical alignment pin 705 can also protrude from a base plate 732 associated with the chair 502 and be received by apertures in a baseplate 730 associated with the gaming terminal 10. Generally, aspects of the alignment pins 704 described herein to advantageously align the respective electrical connector assemblies 620, 720 and allow discharge of static electrical energy prior to electrical coupling apply equally to the conical alignment pins 705.

Figure 8A:
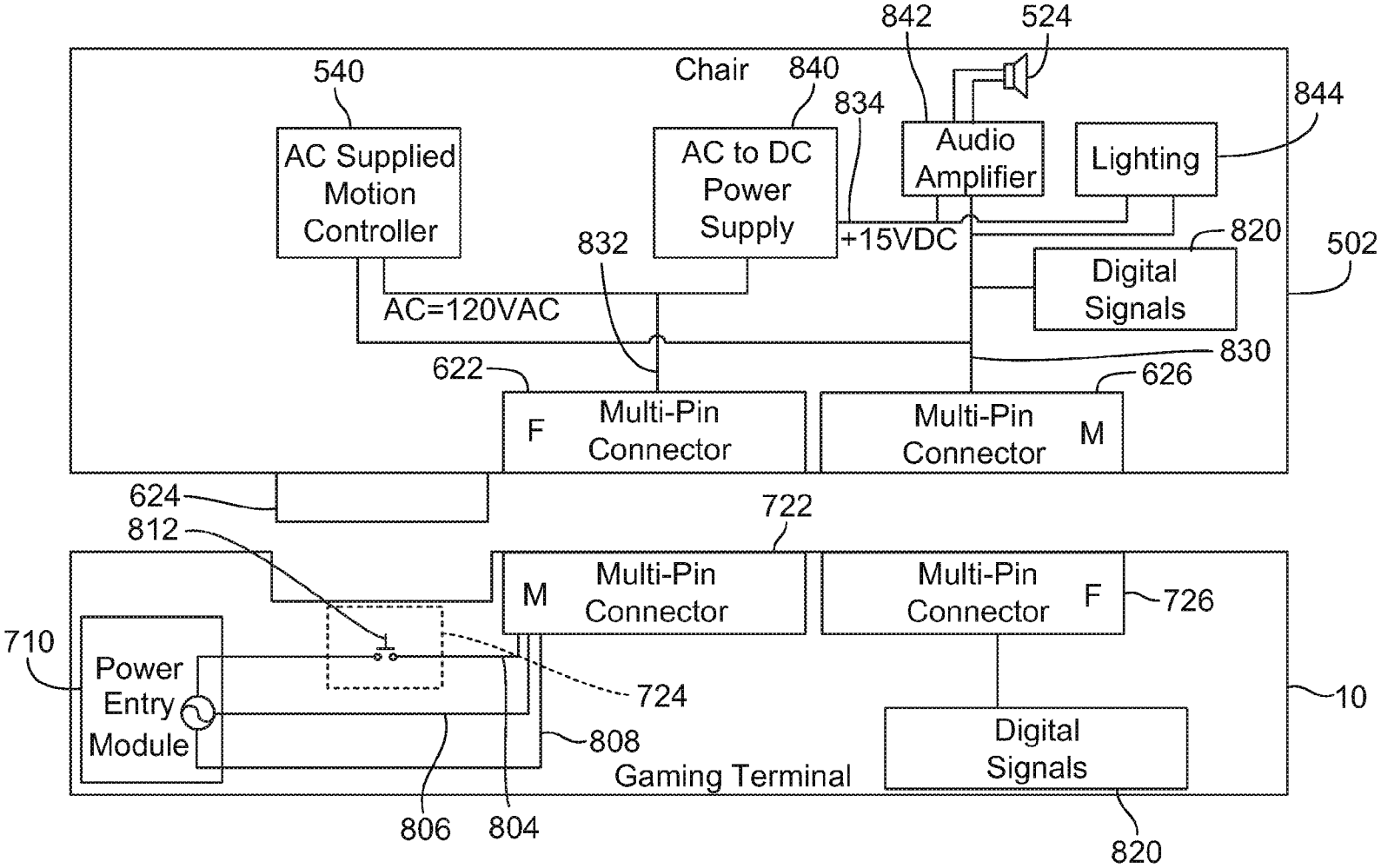
FIG. 8A provides a circuit block diagram of the electrical connector assembly of the gaming terminal and the complementary electrical connector assembly of the chair.

FIG. 8A provides a circuit block diagram of the electrical connector assembly 720 of the gaming terminal 10 and the complementary electrical connector assembly 620 of the chair 502. The power entry module 710 is switchably connected to the power circuit male connector 722. In particular, the power entry module 710 has three outputs: a ground line 808, a neutral line 806, and a high or supply voltage line 804. The high voltage line 804 can conduct, for example, 120 volts AC or 240 volts AC with respect to the neutral line 806. By switching the high voltage line 804 output from the power entry module 710, the switching device 724 controls the delivery of AC power to the electronic components within the chair 502. The digital data circuit female connector 726 receives digital signals 820, which can be signals indicative of audio or video content to be provided to the electronic components within the chair 502. The digital data signals 820 may include signals indicative of instructions to operate the motion generating apparatus 540. Furthermore, in implementations of the chair 502 including input devices for a player to provide inputs for interacting with the wagering game (such as inputs indicative of a wager related to the wagering game) the digital signals 820 can include outputs from the input devices of the chair 502 being conveyed to the gaming terminal 10.

The digital signals 820 can generally be signals that are conveyed either to the chair 502 or to the gaming terminal 10. In implementations where the digital signals 820 are conveyed to the gaming terminal 10 from the chair 502, the digital signals 820 can include outputs from sensors associated with the chair 502 (e.g. weight sensors, proximity sensors, and sensors that determine whether the chair 502 is occupied). The digital signals 820 can also include feedback signals that indicate whether the chair 502 is electrical connector assemblies 720, 620 are securely coupled. In general, digital signals as used herein include signals at transistor-transistor logic (TTL) levels, typically not exceeding 12V DC. In contrast, power signals or power supply signals as used herein are alternating currents having levels corresponding to supply voltage levels, such as 120V AC in North America and 240V AC in Europe and elsewhere.

By disconnecting the high voltage line 804 from the power circuit male connector 722 until the same is coupled with its corresponding connector 622, the high or supply voltage signals from the power entry module 710 are prevented from arcing between the two connectors 622, 722 during a coupling of the gaming terminal 10 and the chair 502. As will be appreciated, preventing arcing from occurring during disconnection and connection events increases the safety of the gaming terminal 10 and its surrounding areas. In addition, the reliability of the electrical connection of the two connectors 622, 722 is increased by preventing the degrading of the connectors 622, 722 that otherwise occurs due to arcing. These advantages are particularly important in implementations where the chair 502 is frequently disconnected and reconnected in order to, for example, service, clean, and otherwise maintain the areas around the gaming terminal 10 as is typical in a gaming venue.

Within the chair 502, the digital data circuit male connector 626 is coupled to one or more electrical cables providing digital signals 830 to the electronic components within the chair 502. For example, as shown in FIG. 8A, the digital signals 830 are connected to an audio amplifier 842, the motion generating apparatus 540, and a programmable light display 844. The power circuit female connector 832 is coupled to one or more electrical cables for delivering the AC power signals 832 to the motion generating apparatus 540, and an AC to DC power supply 840. The AC to DC power supply 840, which can be, for example, a rectifier, delivers DC power signals 834 to the audio amplifier 842 and the programmable light display 844. In an implementation, the AC power signals can be 120 volts AC power signals oscillating at 60 Hertz or can be 230 volts AC power signals oscillating at 50 Hertz. The DC power signals 834 can be, for example, 15 volts DC power signals. The programmable light display 844 can be a marquee with scrolling and/or blinking lights, or can be a display screen that is driven according to instructions indicated by the digital signals 830. The audio amplifier 842 is then coupled to the speaker 524, and optionally to other speakers (such as the speaker 526 and subwoofer 528 shown in FIG. 5).

Figure 8B:
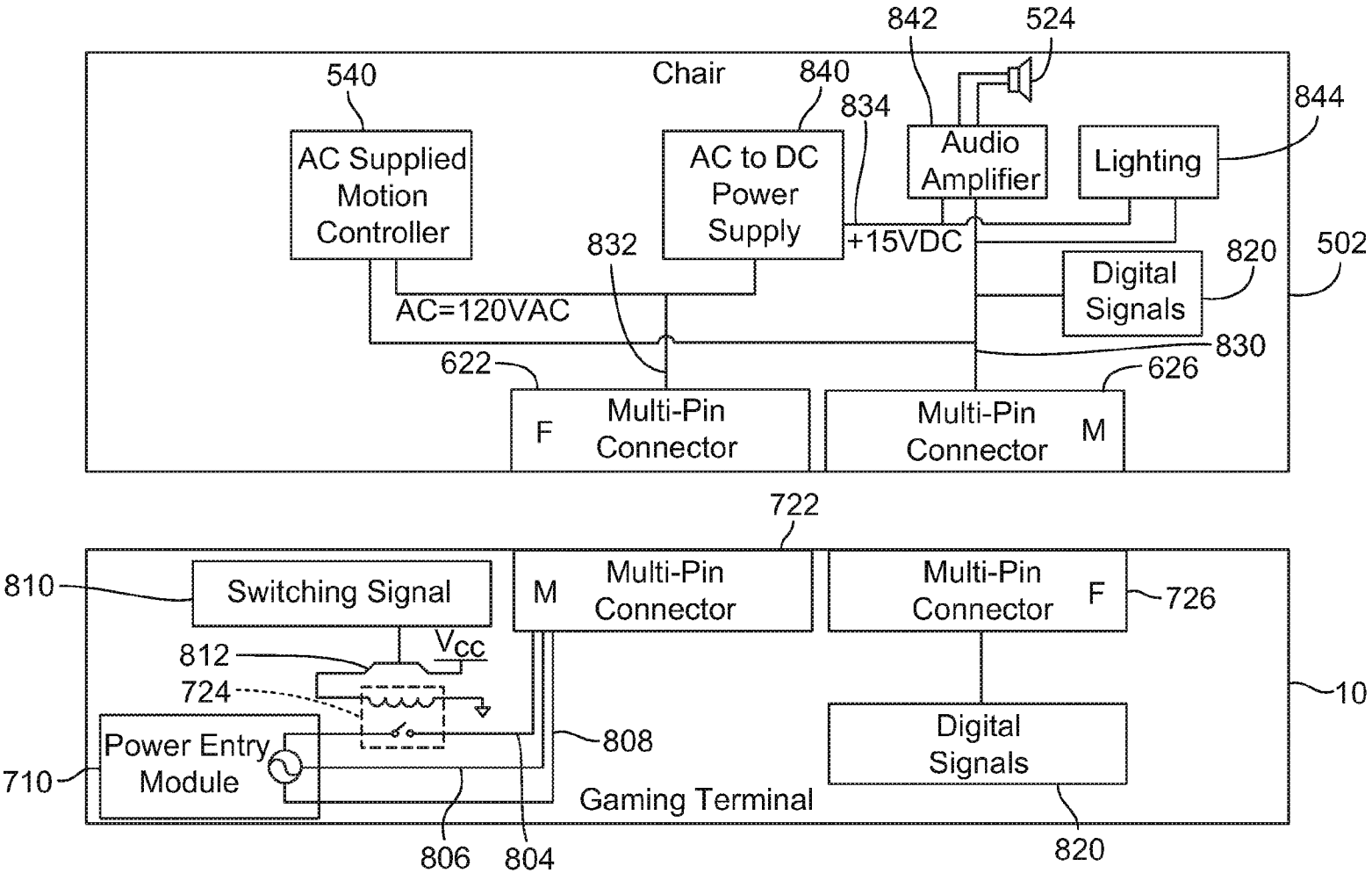
FIG. 8B provides an alternative arrangement of a circuit block diagram of the electrical connector assembly of the gaming terminal, the complementary electrical connector assembly of the chair.

FIG. 8B provides an alternative arrangement of a circuit block diagram of the electrical connector assembly 720 of the gaming terminal 10 and the complementary electrical connector assembly 620 of the chair 502. In FIG. 8B the chair 502 need not include the switch activator 624 to activate the switching device 724. Instead, the switching device 724 is implemented as a relay circuit which utilizes an inductive force to open and/or close contacts that allow current to flow from the power entry module 710 to the power circuit male connector 722. The relay circuit of the switching device 724 has a transistor 812 that is turned on according to a switching signal 810 coupled to the gate of the transistor 812. The switching signal 810 can be a transistor-transistor logic (TTL) type signal that is at a high level when the switching device 724 is desired to be in a closed state and is at a low level when the switching device 724 is desired to be in an open state. When the switching signal 810 is applied to the gate of the transistor 812, current flows through the relay circuit (e.g. from the portion labeled as $V_{CC}$) and inductive forces generated within the switching device 724 close contacts (e.g. force contacts together). The high or supply voltage signal from the power entry module 710 then flows across the closed contacts, through the high voltage line 804, and to the power circuit male connector 722. The switching signal 810 can be a logical signal provided by the gaming terminal 10, such as a signal generated in response to an alarm condition. The switching signal 810 can also be a signal that is generated in response to detecting that the chair 502 is securely mechanically and electrically coupled to the gaming terminal 10. For example, the switching signal 810 can be generated according to outputs from systems adapted to detect the presence of the chair 502 such as proximity sensors or contact sensors.

The switching signal 810 can also be generated by a circuit having an electrical path that flows across one or both of the respective connectors 622, 722 or 626, 726. For example, a circuit providing the switching signal 810 can utilize two electrical terminals in the respective connectors (e.g. one electrical terminal from the connectors 622 and 722, and one electrical terminal from the connectors 624, 724), which are electrically coupled to one another on the chair side of the circuit. The circuit can be configured to detect continuity between the respective terminals on the gaming terminal 10 side of the circuit. In this way, continuity is only detected when both sets of the respective connectors (e.g. 622, 722 and 626, 726) are securely coupled to one another. Of course, alternative circuits can be devised to provide a feedback signal indicative of the gaming terminal 10 being securely electrically mounted to the chair 502, such as circuits utilizing a single electrical terminal and monitoring a change in resistance associated with the terminal, circuits utilizing two or more electrical terminals within each pair of respective terminals (e.g. 622, 722 or 626, 726) to detect continuity between the terminals, etc. Furthermore, the switching signal 810 can be provided by a combination of feedback signals generated in circuits having conductive paths crossing between the gaming terminal 10 and the chair 502 and signals provided from the gaming terminal 10.

Figure 9A:
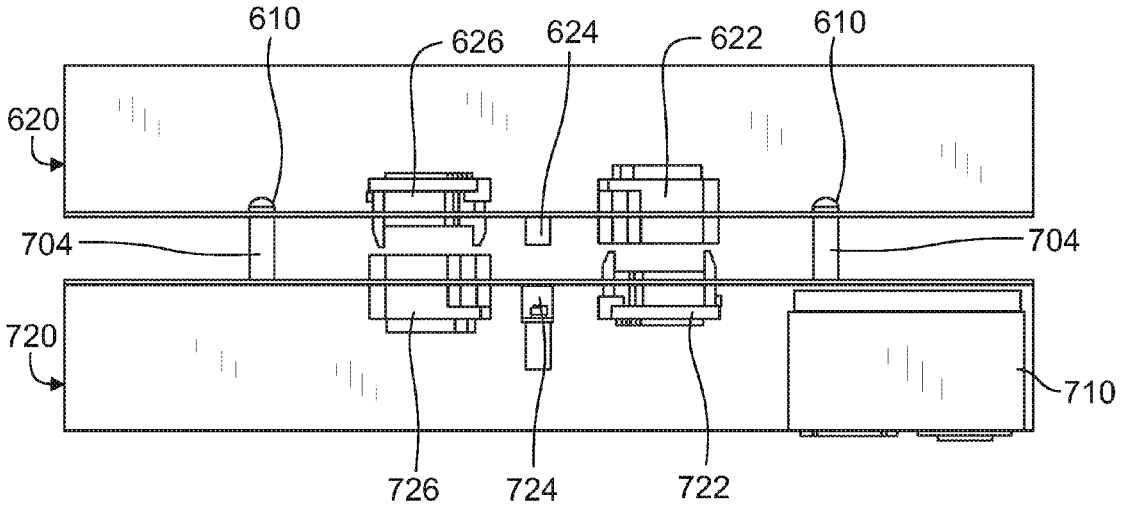
FIG. 9A provides a top view of the electrical connector assembly on the gaming terminal and the complementary electrical connector assembly where the alignment pins are just beginning to be received by the apertures.
Figure 9B:
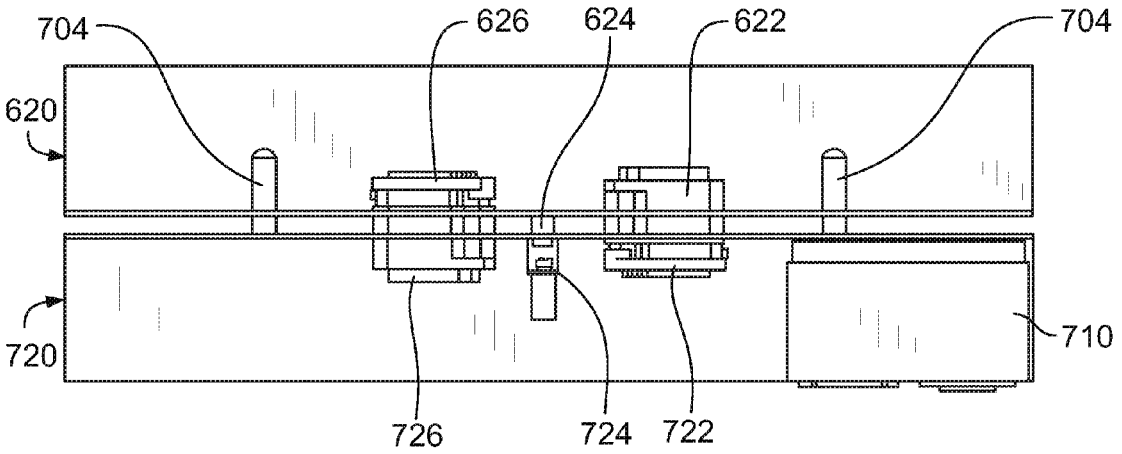
FIG. 9B provides a top view of the electrical connector assembly on the gaming terminal and the complementary connector assembly on the chair where the respective electrical connectors are securely coupled and just before the switching device is activated by the switch activator.

FIGS. 9A and 9B provide two views of positions of the respective connector assemblies 720, 620 and are described for exemplary purposes as sequential positions in an electrical coupling event between the chair 502 and the gaming terminal 10.

FIG. 9A provides a top view of the electrical connector assembly 720 on the gaming terminal 10 and the complementary electrical connector assembly 620 where the alignment pins 704 are just beginning to be received by the apertures 610. In the position shown, the power circuit male and female connectors 622, 722 are aligned to be coupled together, but are not yet touching. Similarly, the digital data circuit male and female connectors 626, 726 are aligned to be coupled together, but are not yet touching. The switch activator 624, which protrudes from the metallic base plate 628 is aligned to be received by the switching device 724, but is not yet engaging the switching device 724. The view shown in FIG. 9A illustrates that during an electrical coupling of the respective electrical connector assemblies 720, 620, the alignment pins 704 provide the first point of connection via the apertures 610. By providing the first point of connection via the alignment pins 704 and apertures 610, the respective electrical connector assemblies 720, 620 are roughly aligned before the connectors (e.g. 622, 722 and 626, 726) are coupled. Furthermore, and as described above, the alignment pins 704 provide for the discharge of electrostatic energy prior to the connectors (e.g. 622, 722 and 626, 726) being coupled.

FIG. 9B provides a top view of the electrical connector assembly 720 on the gaming terminal 10 and the complementary connector assembly 620 on the chair 502 where the respective electrical connectors (622, 722 and 626, 726) are securely coupled. The view shown in FIG. 9B occurs just before the switching device 724 is activated by the switch activator 624. In the position shown in FIG. 9B, the power circuit male and female connectors 622, 722 are securely coupled together. Similarly, the digital data circuit male and female connects 626, 726 are securely coupled together. However, the switching device 724 is not yet activated. The switching device 724 is not yet engaged by the switch activator 624, as the switch activator must travel into the cavity of the switching device 724 before engaging the switching device 724. The chair 502 will travel slightly further toward the gaming terminal 10 to close the remaining gap between the two. Once the chair 502 is fully seated against the gaming terminal 10, the switching device 724 will be engaged by the switch activator 624, and the power entry module 710 will be coupled to the power circuit male connector 722 so as to provide AC power to the electronic components within the chair 502.

FIGS. 9A and 9B are described above as relating to a procedure for coupling the chair 502 to the gaming terminal 10 where the chair 502 is urged toward the gaming terminal 10 such that the arrangement shown in FIG. 9A precedes that shown in FIG. 9B. However, the description also applies to the reverse procedure, such as a procedure for decoupling the chair 502 from the gaming terminal 10 by urging the chair 502 away from the gaming terminal 10. In a decoupling procedure, the arrangement shown in FIG. 9B precedes that shown in FIG. 9A. In particular, during a decoupling procedure the switching device is disengaged so as to disconnect the power entry module 710 from the power circuit male connector 722 prior to the disconnection of the power circuit male and female connectors 622, 722. By disengaging the switching device 724 prior to disconnecting the power circuit connectors 622, 722, the decoupling procedure is made safer by reducing the risk of arcing between the respective connectors 622, 72 and thereby increases the safety of the area surrounding the gaming terminal 10. In addition, the reliability of the electrical connection between the respective connectors 622, 722 is improved because the connectors are not degraded by such arcing.

Figure 10A:
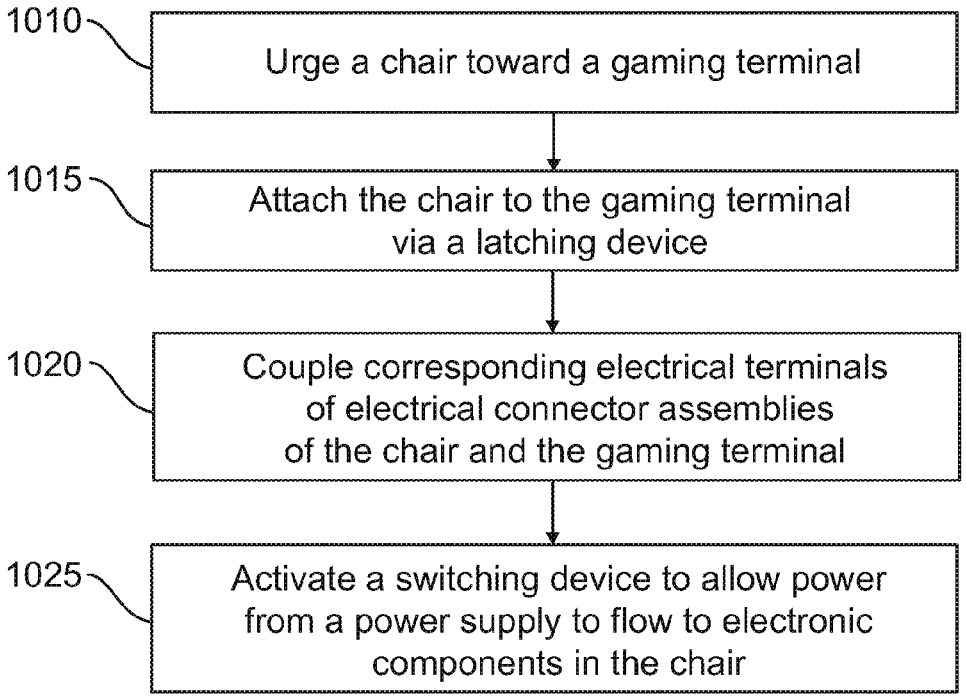
FIG. 10A is a flowchart of an exemplary operation for electrically coupling the chair to the gaming terminal.

FIG. 10A is a flowchart of an exemplary operation for electrically coupling the chair 502 to the gaming terminal 10. The chair 502 is urged toward the gaming terminal 10 (1010). The chair 502 can be rolled (e.g. via the wheels 606) along a path that aligns the electrical connector assembly 720 with the complementary electrical connector assembly 620. The chair 502 is removably attached to the gaming device 10 via the latching device 602 (1015). The latching device 602 can removably attach the chair 502 by securing the cams 608 on respective mating connectors on the gaming terminal 10. The electrical connector assemblies 720, 620 are coupled together such that corresponding electrical terminals of the electrical coupling assemblies 720, 620 are securely coupled together (1020). In an implementation, the coupling of the electrical connector assemblies 720, 620 can occur simultaneously with the mechanical coupling of the chair 502 to the gaming terminal via the latching device 602. The switching device 724 is activated to allow power from the power entry module 710 to flow to electronic components in the chair 502 (1025). The activating of the switching device 724 advantageously occurs after the respective electrical coupling assemblies are coupled together.

Figure 10B:
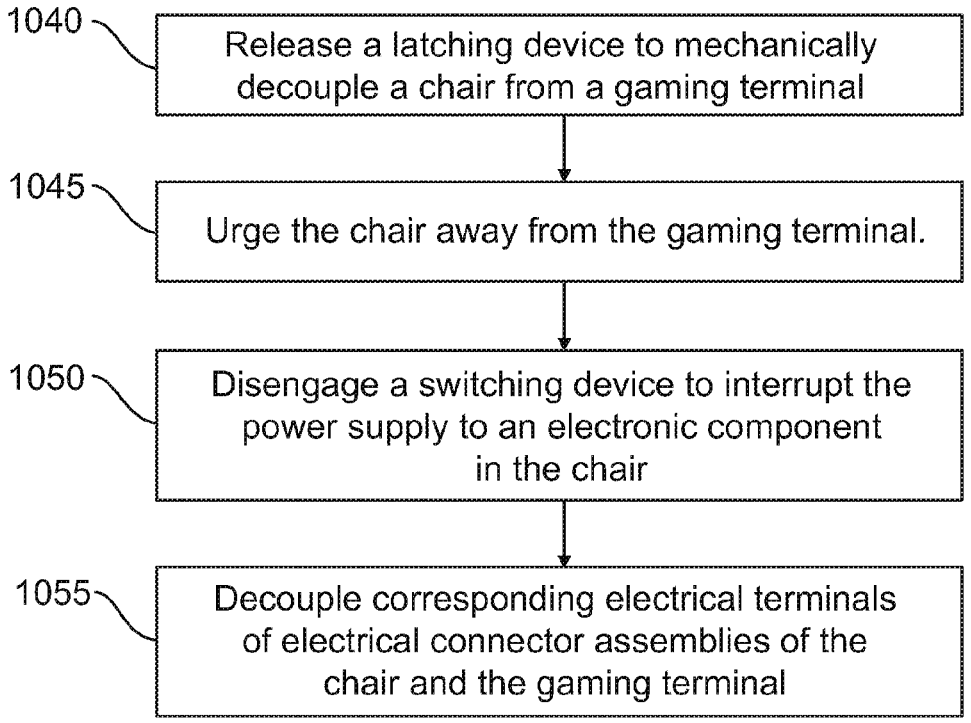
FIG. 10B is a flowchart of an exemplary operation for electrically decoupling the chair from the gaming terminal.

FIG. 10B is a flowchart of an exemplary operation for electrically decoupling the chair 502 from the gaming terminal 10. The latching device 602 is released by pulling the release handle 552 to decouple the chair 502 from the gaming terminal 10 (1040). The chair 502 is urged away from the gaming terminal 10 (1045). The switching device 724 is disengaged such that power delivered to electronic components in the chair 502 from the power entry module 710 is interrupted (1050). For example, the switching device 724 can be turned off in block 1050. After disengaging the switching device 724, the electrical connector assemblies 720, 620 are decoupled (1055). The electrical connector assemblies 720, 620 are decoupled such that corresponding electrical terminals of the electrical coupling assemblies 720, 620 are decoupled.

While many preferred embodiments and best modes for carrying out the present invention have been described in detail above, those familiar with the art to which this invention relates will recognize various alternative designs and embodiments for practicing the invention within the scope of the appended claims.

What is claimed is:

1. A gaming system for providing a wagering game, the gaming system comprising:

a gaming terminal having an input device for receiving an indication of a wager to play the wagering game, the gaming terminal further having an electrical connector assembly;

a chair configured to receive, via a complementary electrical connector assembly corresponding to the electrical connector assembly of the gaming terminal, an alternating current power supply signal from an alternating current power supply via an alternating current connector and a digital data signal via a digital data signal connector, the digital data signal connector preventing interference from the alternating current power supply signal; and a switching device adapted to automatically electrically couple the alternating current power supply to electronics in the chair responsive to the electrical connector assembly of the gaming terminal being removably physically mated to the complementary electrical connector assembly of the chair.

2. The gaming system of claim 1, further comprising:

a power entry module coupled, via the switching device, to the electrical connector assembly of the gaming terminal, the power entry module having at least one terminal adapted to receive the alternating current power supply signal from the alternating current power supply, and wherein the switching device comprises a mechanically depressible electrical switch configured to electrically couple a supply voltage line of the alternating current power supply to the electrical connector assembly responsive to the chair being removably coupled to the gaming terminal.

3. The gaming system of claim 2, wherein the mechanically depressible electrical switch is aligned to be automatically depressed by a switch activator as the chair is urged toward the gaming terminal.

4. The gaming system of claim 3, wherein a distance between the switch activator and the switching device is such that the switching device is disengaged responsive to the chair being urged away from the gaming terminal, the switching device being disengaged prior to decoupling of electrical terminals of the electrical connector assembly from corresponding electrical terminals of the complementary electrical connector assembly.

5. The gaming system of claim 1, wherein the switching device comprises an electrical relay circuit configured to selectively electrically couple a supply voltage line of the alternating current power supply to the electrical connector assembly according to a feedback signal.

6. The gaming system of claim 5, wherein the feedback signal is provided by a feedback circuit having an electrical path passing between the electrical connector assembly and the complementary electrical connector assembly.

7. The gaming system of claim 5, wherein the electrical relay circuit is further configured to selectively electrically couple the supply voltage line of the alternating current power supply to the electrically connector assembly according to a switching signal from the gaming terminal.

8. The gaming system of claim 1, further comprising a latching device to removably couple the chair to the gaming terminal, wherein the chair comprises a base having a sled configured to slidably couple to the gaming terminal, and wherein the sled of the chair is adapted to removably couple to the gaming terminal via the latching device.

9. The gaming system of claim 1, wherein the gaming terminal is adapted for detecting whether the electrical connector assembly is coupled to the complementary electrical connector assembly.

10. The gaming system of claim 1, wherein the complementary electrical connector assembly has a first blind mate connector for receiving the alternating current power supply signal and a second blind mate connector for receiving the digital data signal, and wherein the electrical connector assembly has a first blind mate connector switchably connected to the alternating current power supply and a second blind mate connector for transmitting the digital data signal.

11. The gaming system of claim 1, wherein the electrical connector assembly has a male connector and a female connector, and wherein the complementary electrical connector assembly has a male connector and a female connector, and wherein the female connector of the electrical connector assembly is positioned to receive the male connector of the complementary electrical connector assembly and the female connector of the complementary electrical connector assembly is positioned to receive the male connector of the electrical connector assembly.

12. The gaming system of claim 1, wherein the digital data signal includes an audio signal for driving a speaker associated with the chair or a display signal for programming a display mounted to the chair.

13. The gaming system of claim 1, wherein the complementary electrical connector assembly is electrically coupled to a motion generating apparatus configured to move the chair according to the digital data signal conveyed to the chair via the complementary electrical connector assembly, the motion generating apparatus being configured to be powered by the alternating current power supply signal.

14. The gaming system of claim 1, further comprising:

a plurality of metallic alignment pins;

a plurality of apertures formed in a metallic base and positioned to receive therein respective ones of the alignment pins responsive to the chair being urged toward the gaming terminal and to cause electrostatic energy to discharge through the metallic base; and a switch activator positioned to engage the switching device responsive to the chair being urged toward the gaming terminal after coupling of the electrical connector assembly to the complementary electrical connector assembly to permit the alternating current power supply signal to flow across the connector assemblies, and to disengage the switching device responsive to the chair being urged away from the gaming terminal and prior to decoupling the electrical connector assembly from the complementary electrical connector assembly such that the alternating current power supply signal is interrupted prior to interruption of the digital data signal between the chair and the gaming terminal.

15. The gaming system of claim 1, further comprising:

one or more alignment features having tapered ends; and one or more openings formed in a metallic base and positioned to interface with the one or more alignment features so as to automatically align the electrical connector assembly with the complementary electrical connector assembly responsive to the chair being urged toward the gaming terminal.

16. A system for electrically coupling a gaming terminal to an associated chair positioned in front of the gaming terminal, the gaming terminal being adapted for receiving an indication of a wager from a player for playing a wagering game via the gaming terminal, the system comprising:

an electrical connector assembly mounted to the gaming terminal, the electrical connector assembly including a first electrical connector accessible from an exterior of the gaming terminal and a second electrical connector conducting a digital data signal between the terminal and the chair; and a switching device for automatically electrically coupling an alternating current power supply to the first electrical connector responsive to the electrical connector assembly being removably physically mated to a complementary electrical connector assembly of the chair, the second electrical connector preventing interference from the alternating current power supply.

17. The system of claim 16, wherein the switching device includes a depressible member biased in an off position of the switching device, the depressible member being adapted to be depressed to an on position of the switching device by a switch activator during a mechanical coupling of the gaming terminal and the chair.

18. The system of claim 16, wherein the switching device includes a relay circuit for activating the switching device responsive to a switching signal from the gaming terminal or responsive to a feedback signal provided responsive to the first electrical connector being securely coupled to a corresponding electrical connector of the complementary electrical connector assembly.

19. The system of claim 16, wherein one of the first electrical connector and the second electrical connector being a male blind-mate connector and the other being a female blind-mate connector.

20. The system of claim 16, wherein the switching device is arranged such that the switching device is disengaged responsive to the chair being urged away from the gaming terminal and prior to decoupling of electrical terminals of the electrical connector assembly from corresponding electrical terminals of the complementary electrical connector assembly such that the alternating current power supply is decoupled from the first electrical connector prior to decoupling of the electrical connector assembly from the complementary electrical connector assembly.

21. The system of claim 16, wherein the electrical connector assembly includes a plurality of metallic alignment pins positioned to be received by a plurality of apertures formed in a metallic base movable with the chair responsive to the chair being urged toward the gaming terminal, or wherein the electrical connector assembly includes a plurality of apertures formed in a metallic base of the gaming terminal and positioned to receive therein metallic alignment pins movable with the chair responsive to the chair being urged toward the gaming terminal, and wherein the plurality of metallic alignment pins or the plurality of apertures of the electrical connector assembly cause electrostatic energy to discharge between the gaming terminal and the chair prior to electrically coupling the gaming terminal to the chair.

22. A system for electrically coupling a chair to a gaming terminal, the gaming terminal being adapted for receiving an indication of a wager from a player for playing a wagering game via the gaming terminal, the system comprising:

an electrical connector assembly for conveying alternating power supply signals from a power supply to an electronic component associated with the chair, the electrical connector assembly including a first electrical connector electrically connected to the electronic component and a second electrical connector conducting a digital data signal between the terminal and the chair, the electrical connector assembly movable with the chair; and a switch activator for automatically activating a switching device adapted for coupling the power supply to a connector corresponding to the first electrical connector responsive to the electrical connector assembly being removably physically mated to a complementary electrical connector mounted to the gaming terminal the second electrical connector preventing interference from the alternating current power supply signal.

23. The system of claim 22, wherein the switch activator is adapted for depressing a depressible member of the switching device, the depressible member being biased in an off position of the switching device, the switch activator being positioned for depressing the depressible member to an on position of the switching device during a mechanical coupling of the chair to the gaming terminal.

24. The system of claim 22, wherein the switching device includes a relay circuit for activating the switching device, the relay circuit being activated according to a switching signal generated based on an electrical connection between the electrical connector assembly of the chair and the complementary electrical connector assembly of the gaming terminal.

25. The system of claim 22, wherein one of the first electrical connector and the second electrical connector being a male blind-mate connector and the other being a female blind-mate connector.

26. The system of claim 22, wherein the switch activator is arranged such that the switching device is disengaged responsive to the chair being urged away from the gaming terminal and prior to decoupling of electrical terminals of the electrical connector assembly from corresponding electrical terminals of the complementary electrical connector assembly such that the power supply is decoupled from the connector corresponding to the first electrical connector prior to decoupling of the electrical connector assembly from the complementary electrical connector assembly.

27. The system of claim 22, wherein the electrical connector assembly includes a plurality of metallic alignment pins positioned to be received by a plurality of apertures formed in a metallic base of the gaming terminal responsive to the chair being urged toward the gaming terminal, or wherein the electrical connector assembly includes a plurality of apertures formed in a metallic base movable with the chair and positioned to receive therein metallic alignment pins of a base of the gaming terminal responsive to the chair being urged toward the gaming terminal, and wherein the plurality of metallic alignment pins or the plurality of apertures of the electrical connector assembly cause electrostatic energy to discharge between the chair and the gaming terminal prior to electrically coupling the chair to the gaming terminal.

28. A system for safely electrically coupling a gaming terminal to a chair positioned in front of the gaming terminal, the gaming terminal being adapted for receiving an indication of a wager from a player related to a wagering game, the system comprising:

an electrical connector assembly mounted to a base of the gaming terminal, the electrical connector assembly including a plurality of terminals, the plurality of terminals including an alternating current terminal transmitting an alternating current power signal and a digital data signal terminal transmitting digital signals, the digital data signal terminal preventing interference from the alternating current power supply signal;

a complementary electrical connector assembly movable with the chair, the complementary electrical connector assembly including a plurality of terminals adapted to mate with the plurality of terminals of the electrical connector assembly, the complementary electrical connector assembly electrically coupled with an electronic component adapted to receive power from an alternating current power supply via the alternating current power supply signal; and means for selectively electrically coupling the alternating current power supply to the plurality of terminals of the electrical connector assembly responsive to the plurality of terminals of the electrical connector assembly and the complementary electrical connector assembly being physically mated.

29. The system of claim 28, wherein the digital data signals control at least the electronic component associated with the chair.

30. A method for electrically coupling a gaming terminal to a chair, the gaming terminal being adapted for receiving an indication of a wager from a player for playing a wagering game via the gaming terminal, the method comprising:

urging the chair toward the gaming terminal, the gaming terminal having an electrical connector assembly with a plurality of electrical terminals corresponding to a plurality of complementary electrical terminals of a complementary electrical connector assembly, the plurality of electrical terminals including an alternating current terminal transmitting an alternating current power signal and a digital data signal terminal transmitting digital signals, the digital data signal terminal preventing interference from the alternating current power supply signal, the complementary electrical connector assembly being mounted to the chair, the chair being positioned such that the electrical connector assembly is aligned to receive the complementary electrical connector assembly;

removably attaching the chair to the gaming terminal via a latching device;

physically mating the respective plurality of electrical terminals of the electrical connector assembly and the complementary electrical connector assembly; and automatically activating a switching device responsive to the respective plurality of electrical terminals of the electrical connector assembly and the complementary electrical connector assembly being physically mated, the switching device being adapted for connecting an alternating current power supply to the electrical connector assembly of the gaming terminal such that power from the alternating current power supply is delivered to an electronic component associated with the chair via the complementary electrical connector assembly.

31. The method of claim 30, further comprising, prior to the securely coupling:

aligning the electrical connector assembly with the complementary electrical connector assembly by receiving a plurality of metallic alignment pins in a plurality of apertures in a metallic base positioned to receive respective ones of the plurality of alignment pins; and discharging electrostatic energy via the plurality of metallic alignment pins and the metallic base.

32. The method of claim 30, wherein the switching device includes a mechanically depressible switch biased in an off position and wherein the activating the switching device further includes:

pressing a switch activator against the mechanically depressible switch, the switch activator being movable with the complementary electrical connector assembly; and overcoming a bias of the mechanically depressible switch such that the switching device is turned on.

* * * * *